US008432347B2

(12) United States Patent
Hiraki et al.

(10) Patent No.: US 8,432,347 B2
(45) Date of Patent: Apr. 30, 2013

(54) DRIVING METHOD AND DRIVE CONTROL CIRCUIT OF LIQUID CRYSTAL DISPLAY DEVICE, AND LIQUID CRYSTAL DISPLAY DEVICE INCLUDING THE SAME

(75) Inventors: Katsuyoshi Hiraki, Kawasaki (JP); Yasutake Furukoshi, Kawasaki (JP); Koichi Katagawa, Kawasaki (JP); Masanori Nishido, Kawasaki (JP); Tetsuya Kobayashi, Kawasaki (JP)

(73) Assignee: Sharp Kabushiki Kaisha, Osaka (JP)

( * ) Notice: Subject to any disclaimer, the term of this patent is extended or adjusted under 35 U.S.C. 154(b) by 1202 days.

(21) Appl. No.: 12/008,634

(22) Filed: Jan. 11, 2008

(65) Prior Publication Data

US 2008/0122778 A1 May 29, 2008

Related U.S. Application Data

(62) Division of application No. 10/603,067, filed on Jun. 24, 2003, now Pat. No. 7,342,561.

(30) Foreign Application Priority Data

Jun. 27, 2002 (JP) ..... 2002-187447
Mar. 11, 2003 (JP) ..... 2003-065443

(51) Int. Cl.
*G09G 3/36* (2006.01)

(52) U.S. Cl.
USPC ..... 345/98; 345/89; 345/93; 345/95; 345/97; 345/102

(58) Field of Classification Search ..... 345/629, 345/690, 59, 63, 87–100, 204–214, 698; 327/563; 358/474, 496, 497; 348/674
See application file for complete search history.

(56) References Cited

U.S. PATENT DOCUMENTS

| | | | | |
|---|---|---|---|---|
| 4,128,846 | A | 12/1978 | Robinson, Jr. | |
| 5,250,937 | A * | 10/1993 | Kikuo et al. | 345/89 |
| 5,379,050 | A * | 1/1995 | Annis et al. | 345/94 |
| 5,398,040 | A | 3/1995 | Ogino et al. | |
| 5,748,167 | A | 5/1998 | Watanabe et al. | |
| 5,754,249 | A | 5/1998 | Zhaog | |
| 5,892,494 | A * | 4/1999 | Kimura et al. | 345/96 |

(Continued)

FOREIGN PATENT DOCUMENTS

| | | |
|---|---|---|
| JP | 05-196914 | 8/1993 |
| JP | 05-236400 | 9/1993 |

(Continued)

*Primary Examiner* — Prabodh M Dharia
(74) *Attorney, Agent, or Firm* — Greer, Burns & Crain, Ltd.

(57) ABSTRACT

A drive control circuit includes a timing controller for detecting a change of a horizontal scanning frequency, a gate voltage generating circuit for generating two kinds of gate-on voltages Va and Vb (Va<Vb), and a switch for outputting one of the gate-on voltages Va and Vb from the gate voltage generating circuit in accordance with an output of the timing controller. The timing controller includes a counter for counting the number of clocks for one horizontal period, and a comparator for comparing a count result with a threshold value. When the horizontal scanning frequency is in a normal state, the low gate-on voltage Va is outputted, and when the horizontal scanning frequency exceeds a predetermined threshold value, that is, the count value falls below a threshold value, the high gate-on voltage Vb is outputted.

9 Claims, 17 Drawing Sheets

U.S. PATENT DOCUMENTS

| | | | | |
|---|---|---|---|---|
| 5,940,058 | A * | 8/1999 | Koyama | 345/89 |
| 5,990,979 | A * | 11/1999 | Koyama et al. | 348/674 |
| 6,091,391 | A * | 7/2000 | Ling et al. | 345/98 |
| 6,151,007 | A * | 11/2000 | Kasai et al. | 345/95 |
| 6,245,590 | B1 | 6/2001 | Wine et al. | |
| 6,313,813 | B1 | 11/2001 | Narui et al. | |
| 6,515,676 | B1 * | 2/2003 | Kasai et al. | 345/629 |
| 6,781,605 | B2 * | 8/2004 | Kudo et al. | 345/690 |
| 6,806,861 | B1 * | 10/2004 | Sakaguchi et al. | 345/100 |
| 6,816,131 | B2 | 11/2004 | Narui et al. | |
| 6,924,782 | B1 * | 8/2005 | Fujioka et al. | 345/92 |
| 7,006,065 | B1 * | 2/2006 | Sugawara et al. | 345/89 |
| 7,307,610 | B2 * | 12/2007 | Sakaguchi | 345/89 |
| 7,342,561 | B2 * | 3/2008 | Hiraki et al. | 345/87 |
| 7,671,829 | B2 * | 3/2010 | Sugawara et al. | 345/89 |
| 2001/0033260 | A1 * | 10/2001 | Nishitani et al. | 345/87 |
| 2001/0055007 | A1 * | 12/2001 | Miura et al. | 345/204 |
| 2002/0186231 | A1 * | 12/2002 | Kudo et al. | 345/690 |
| 2003/0034947 | A1 * | 2/2003 | Tanaka et al. | 345/89 |
| 2003/0052851 | A1 * | 3/2003 | Yano et al. | 345/89 |
| 2003/0063081 | A1 * | 4/2003 | Kimura et al. | 345/211 |
| 2003/0146887 | A1 * | 8/2003 | Mametsuka | 345/76 |
| 2003/0201959 | A1 * | 10/2003 | Sakaguchi | 345/87 |
| 2005/0122287 | A1 * | 6/2005 | Nishitani et al. | 345/63 |
| 2006/0071894 | A1 * | 4/2006 | Sugawara et al. | 345/89 |
| 2006/0164355 | A1 * | 7/2006 | Kim et al. | 345/89 |
| 2007/0222744 | A1 * | 9/2007 | Okita et al. | 345/102 |

FOREIGN PATENT DOCUMENTS

| | | |
|---|---|---|
| JP | 06-230342 | 8/1994 |
| JP | 08-054859 | 2/1996 |
| JP | 08-095004 | 4/1996 |
| JP | 10-319914 | 12/1998 |
| JP | 11-109925 | 4/1999 |
| JP | 11-184436 | 7/1999 |

* cited by examiner

PRIOR ART

DRIVING METHOD AND DRIVE CONTROL CIRCUIT OF LIQUID CRYSTAL DISPLAY DEVICE, AND LIQUID CRYSTAL DISPLAY DEVICE INCLUDING THE SAME

This is a divisional of application Ser. No. 10/603,067, filed Jun. 24, 2003.

BACKGROUND OF THE INVENTION

1. Field of the Invention

The present invention relates to a driving method and a drive control circuit of a liquid crystal display device, and a liquid crystal display device including the same.

2. Description of the Related Art

In recent years, both the resolution and the display density of an active matrix type liquid crystal display device (LCD) have become remarkably high. In the case where the resolution is not very high, it is possible to sufficiently secure an on time (writing time) of a gate signal (gate pulse) applied to a gate electrode of a thin film transistor (TFT) formed as a liquid crystal drive switching element in each pixel. Thus, even if the voltage (gate-on voltage) of the gate pulse at the on time is not made high, a gradation voltage can be certainly written to a pixel electrode, and excellent display quality can be obtained. However, when the number of gate bus lines is increased in order to raise the resolution, in the case where a vertical scanning period is constant, the writing time becomes short, and insufficient writing of the gradation voltage can occur. As solving means of this problem, there is a method in which the gate-on voltage is made high to raise the mobility of the TFT.

However, there is a defect in the method of making the gate-on voltage high. The defect will be described with reference to FIGS. 16 and 17. FIG. 16 shows one gate bus line as a CR distributed constant circuit. As shown in FIG. 16, the gate bus line can be expressed as a circuit in which low-pass filters each composed of a resistance R and a capacitance C are continuously connected. In such a gate bus line, when the width of the gate bus line is made minute to increase the display density, the component of the resistance R is increased, and when the thickness of a gate insulating film is made thin, the component of the capacitance C is increased, and therefore, a gate delay occurs which can not be neglected.

FIG. 17 shows a state of the gate delay of the gate pulse applied to the gate bus line. When the resistance value, load capacitance and the like of the gate bus line itself are increased, as shown in FIG. 17, with respect to the gate pulse outputted to the gate bus line, a round waveform due to the delay hardly occurs in the vicinity of, for example, a pixel 1 at the side close to a gate driver, however, as the gate pulse goes away from the gate driver, for example, in the vicinity of a pixel n (n denotes the maximum number of pixels driven by one gate bus line), a round waveform as shown in the drawing occurs.

In an LCD which performs a color display with three primary colors of R (Red), G (Green) and B (Blue), the number of pixels driven by one gate bus line becomes the resolution in the direction of gate bus line extension×3. For example, the number n of pixels driven by one gate bus line is 1920 (=640×3) in the case where the display system is VGA, n=3072 (=1024×3) in XGA, n=3840 (1280×3) in SXGA and n=4800 (1600×3) in UXGA. When the gate driver for driving gate bus lines outputs rectangular gate pulses at predetermined timings to the respective gate bus lines, the rectangular gate pulses are applied to the gate electrodes of the TFTs of the pixel 1, the pixel 2, the pixel 3 and the like which are close to the gate driver, however, the gate pulses with the round waveforms are applied to the gate electrodes of the TFTs of the pixel (n−1) and the pixel n which are remote from the gate driver. Since the writing condition of the gradation voltage to the pixel electrode is changed by the round waveform among pixels on the same gate bus line, a problem of uneven display and the like occurs. Since the round waveform due to the gate delay becomes remarkable as the gate-on voltage is made high, the display quality becomes apt to deteriorate.

FIGS. 18A to 18E show relation among a round waveform, a writing time and a writing amount. FIG. 18A shows a horizontal synchronizing signal a in the case where a horizontal scanning frequency is "A" kHz, FIG. 18B shows a horizontal synchronizing signal b in the case where a horizontal scanning frequency is "B" (A<B) kHz. A period Thb of the horizontal synchronizing signal b is shorter than a period Tha of the horizontal synchronizing signal a by a time ΔTh.

FIG. 18C shows a waveform of a gate signal in the case of FIG. 18A, and FIG. 18D shows a waveform of a gate signal in the case of FIG. 18B. FIG. 18E is a waveform diagram of a gate signal in the case where the gate-on voltage is made high by ΔV.

As shown in FIG. 18C, the gate pulse outputted from the gate driver has a "H (high)" level only for the same period as the period Tha of the horizontal synchronizing signal a and the gate-on voltage is held. However, although the waveform X of the gate pulse applied to the gate electrode of a TFT of a pixel close to the gate driver becomes rectangular, the rounding as shown in the drawing occurs in the waveform Y of the gate pulse applied to the gate electrode of a TFT of a pixel remote from the gate driver.

When it is assumed that a voltage (threshold voltage) at which a desired mobility can be obtained for a TFT is Va, a period of a portion of the waveform Y not lower than the voltage Va is Ta. When an area of a region surrounded by the line of the voltage Va and the waveform Y is made Sa, the dimension of the area Sa is in proportion to the quantity of electric charge written to the pixel electrode.

As shown in FIG. 18D, the gate pulse outputted from the gate driver has the "H" level for the same period as the period Thb of the horizontal synchronizing signal b, and the gate-on voltage is held. Similarly to the example of FIG. 18C, although a waveform U of a gate pulse applied to a gate electrode of a TFT of a pixel close to the gate driver becomes rectangular, the rounding as shown in the drawing occurs in a waveform W of a gate pulse applied to a gate electrode of a TFT of a pixel remote from the gate driver.

In the same manner as the above, when it is assumed that a voltage at which a desired mobility is obtained for a TFT is Va, a period of a portion of the waveform W not lower than the voltage Va is Tb. When an area of a region surrounded by the line of the voltage Va and the waveform W is made Sb, the dimension of the area Sb is in proportion to the quantity of electric charge written to the pixel electrode.

When the period Ta and the period Tb are compared, the period Tb is shorter than the period Ta by approximately ΔTh, and the area Sa>Sb is satisfied. Accordingly, in the case where the horizontal scanning frequency is relatively high as shown in FIG. 18B, insufficient writing of electric charge occurs.

In order to solve this, it is sufficient if the gate-on voltage is made high. FIG. 18E shows a gate pulse waveform in the case where the gate-on voltage is made high by ΔV in the case where the horizontal scanning frequency is "B" kHz. A waveform P of a gate pulse applied to a gate electrode of a TFT of a pixel close to the gate driver is rectangular, and the rounding as shown in the drawing occurs in a waveform Q of a gate pulse applied to a gate electrode of a TFT of a pixel remote from the gate driver.

The area of a region surrounded by the line of the voltage Va and the waveform Q becomes Sb'+ΔSb. The area ΔSb is an increment due to the rise of the gate-on voltage by ΔV. Although the area Sb is not simply equal to Sb', it is clear that the area Sb<Sb'+ΔSb. By this, since the supply amount of electric charge is increased, the insufficient writing does not occur.

In general, a liquid crystal display device is required to be designed such that it can be sufficiently driven even by a vertical scanning frequency higher than a mainly used vertical scanning frequency so that it can support plural kinds of vertical scanning frequencies of video signals supplied from a system (for example, a personal computer) side. Accordingly, in a driving method of a recent liquid crystal display device, it is necessary to resolve the insufficient writing of gradation data due to high resolution as described above, and it is necessary to support all of plural kinds of vertical scanning frequencies supplied from the system side.

FIG. 19 shows a vertical scanning frequency, a vertical period, a horizontal scanning frequency and a horizontal period. A vertical period Tva is a period of a vertical synchronizing signal (Vsync) and is the reciprocal of a vertical scanning frequency. As shown in FIG. 19, the vertical period Tva is composed of an effective display period and a blank period. The effective display period of the vertical period Tva is a period in which the respective gate bus lines are line-sequentially driven, and FIG. 19 exemplifies gate pulse signals 1001 to 1005 outputted to the respective gate bus lines. In the blank period, the gate bus lines are not driven. On the other hand, a horizontal period Tha is the reciprocal of a horizontal scanning frequency and is almost equal to a period in which a gate pulse has an on state. When the vertical scanning frequency becomes high, the one vertical period Tva becomes short, and the horizontal period Tha in which the gate pulse is kept at the "H" level also becomes short. That is, the horizontal scanning frequency becomes high. However, there is also a case where by shortening the blank period, even if the vertical period Tva becomes short, the effective display period is not made short.

As stated above, when the vertical scanning frequency becomes high, the horizontal scanning frequency also becomes high, and a writing time of a gradation voltage to a pixel electrode becomes short. Accordingly, if the gate voltage is fixed so that writing of the gradation voltage becomes sufficient even at the upper limit of the plural kinds of vertical scanning frequencies supplied from the system side, even at a mainly used vertical scanning frequency, the gate pulse of a high gate-on voltage is outputted to the gate bus line, so that the round waveform becomes severe, and there can occur a problem in display quality.

Incidentally, the following documents are cited for reference.

[Patent Document 1]
JP-A-06-230342
[Patent Document 2]
JP-A-08-54859
[Patent Document 3]
JP-A-11-109925
[Patent Document 4]
JP-A-11-184436

SUMMARY OF THE INVENTION

An object of the invention is to provide a driving method and a drive control circuit of a liquid crystal display device in which even if a vertical scanning frequency or a horizontal scanning frequency is changed, display quality is not degraded, and a liquid crystal display device including the same.

The above object is achieved by a driving method of a liquid crystal display device characterized by comprising a detection step of detecting a change of a vertical scanning frequency or a horizontal scanning frequency, and an output step of outputting, when the change of the vertical scanning frequency or the horizontal scanning frequency is detected at the detection step, a gate-on voltage corresponding to the change.

BRIEF DESCRIPTION OF THE DRAWINGS

FIG. 7A is a circuit block diagram of a gate voltage regulating circuit of an example 1-3, FIG. 7B is a view showing an example of a PWM signal and FIG. 7C is a view showing an example of a voltage stabilizing circuit;

FIG. 8A is a first circuit block diagram of the common voltage regulating circuit and FIG. 8B is a second circuit block diagram of the common voltage regulating circuit;

FIG. 19 is a view showing relation among a vertical synchronizing signal, a vertical period and a horizontal period and the like.

DETAILED DESCRIPTION OF THE PREFERRED EMBODIMENTS

First Embodiment

Figure 1:
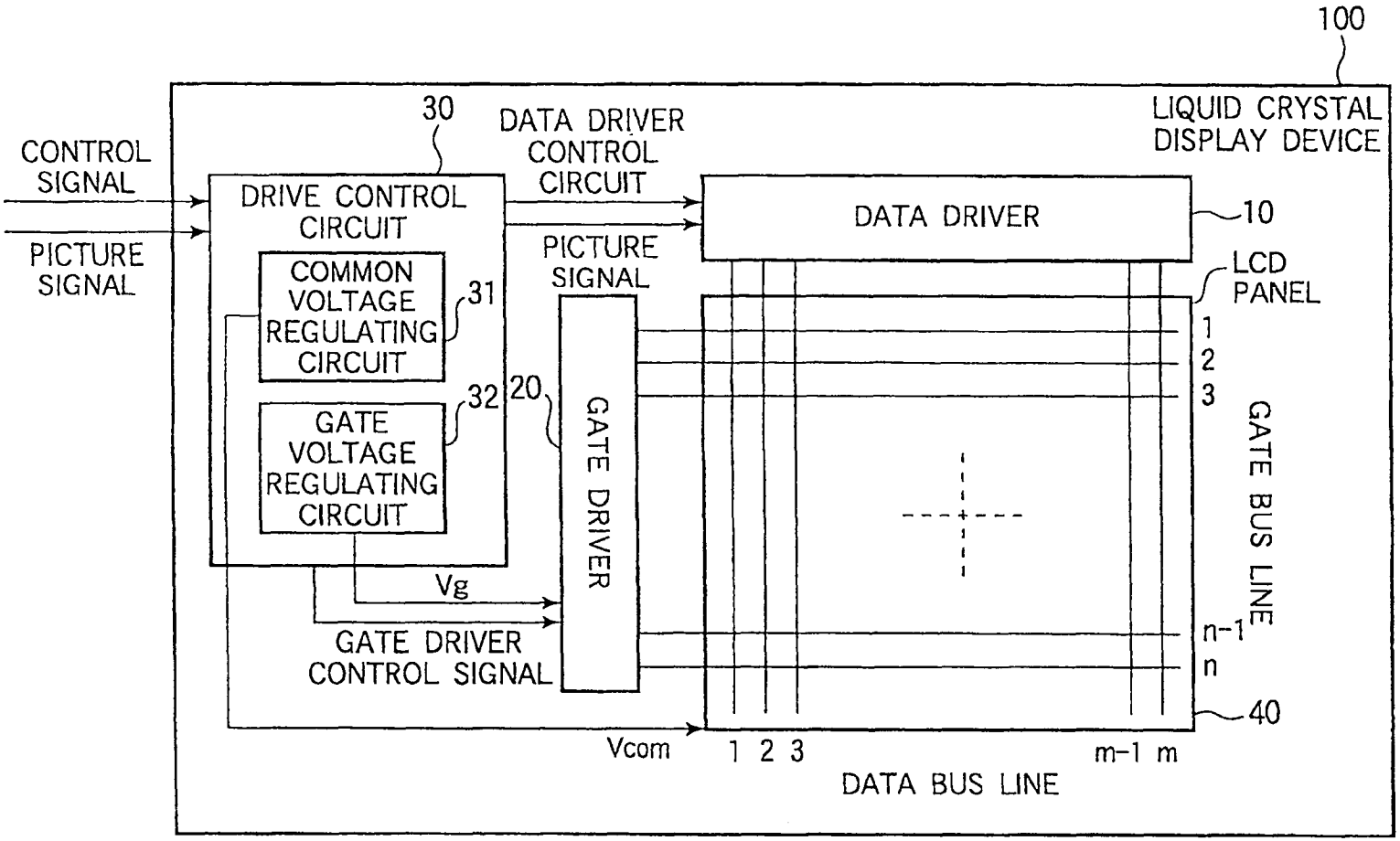
FIG. 1 is a view for explaining a rough structure of a liquid crystal display device according to a first embodiment of the invention.

A driving method and a drive control circuit of a liquid crystal display device according to a first embodiment of the invention, and a liquid crystal display device including the same will be described with reference to FIGS. 1 to 8. First, a rough structure of the liquid crystal display device according to this embodiment will be described with reference to FIG. 1. A liquid crystal display device 100 includes an LCD (Liquid Crystal Display) panel 40 in which n gate bus lines extending in the horizontal direction in the drawing and m data bus lines formed to intersect with the gate bus lines through an insulating film and extending in the vertical direction in the drawing are formed. Regions defined by the gate bus lines and the data bus lines in the LCD panel 40 are pixel regions, and a not-shown TFT is formed in each of the pixel regions arranged in a matrix form. A source electrode of each TFT is connected to a not-shown pixel electrode, a drain electrode is connected to a near data bus line and a gate electrode is connected to a near gate bus line.

Besides, a data driver 10 for driving the m data bus lines and a gate driver 20 for driving the n gate bus lines are disposed in the LCD panel 40. Further, a drive control circuit 30 for outputting various control signals and picture signals (gradation signals, etc.) to the data driver 10 and the gate driver 20 is provided in the LCD panel 40.

The drive control circuit 30 outputs a data driver control signal and a picture signal to the data driver 10. The data driver 10 receives the data driver control signal and the picture signal, and outputs a gradation voltage for each pixel to each data bus line at a predetermined timing. Besides, the drive control circuit 30 outputs a gate-on voltage Vg and a gate driver control signal to the gate driver 20. Various control signals and picture signals are inputted to the drive control circuit 30 from a system side apparatus, for example, a personal computer connected to the liquid crystal display device 100.

The drive control circuit 30 includes a common voltage regulating circuit 31 for outputting a common voltage Vcom to the LCD panel 40 and a gate voltage regulating circuit 32 for outputting the gate-on voltage Vg to the gate driver 20.

The gate driver 20 sequentially outputs gate pulses to the gate bus lines 1 to n on the basis of the gate driver control signal, and sequentially selects the gate bus lines each connected to m pixels to which gradation voltages are to be written. The data driver 10 outputs the gradation voltages for the m pixels connected to the gate bus line selected by the gate driver 20 to the data bus lines 1 to m. By this, the gate bus lines 1 to n are sequentially selected, the predetermined gradation voltages are written to the respective pixels on the selected gate bus line, and a picture of one frame is displayed.

The gate voltage regulating circuit 32 is a circuit for outputting the gate-on voltage Vg corresponding to a change of a horizontal scanning frequency or a vertical scanning frequency. For example, in the case where the vertical scanning frequency is 60 Hz, the gate-on voltage Vg=25 V is outputted, and in the vertical scanning frequency other than that, the gate-on voltage Vg=30 V is outputted. With respect to the change of the gate-on voltage Vg, two or more threshold values, not one threshold value, may be used. For example, in the case where the vertical scanning frequency is 60 Hz, the gate-on voltage Vg=25 V is outputted, and in the case where the vertical scanning frequency is 75 Hz, the gate-on voltage Vg=30 V is outputted.

Further, the threshold value of the vertical scanning frequency or the horizontal scanning frequency in the case where the gate-on voltage is set to be high can be made different from the threshold value of the vertical scanning frequency or the horizontal scanning frequency in the case where the gate-on voltage Vg is set to be low. For example, a setting may be made such that when the horizontal scanning frequency exceeds 65 kHz, the gate-on voltage Vg is changed to 30 V, however, when the gate-on voltage Vg is once changed to 30 V, the gate-on voltage Vg is not to returned to 25 V unless the horizontal scanning frequency becomes less than 60 Hz. Further, the gate-on voltage Vg may be continuously changed in accordance with the change of the horizontal scanning frequency or the vertical scanning frequency without providing a threshold value.

The common voltage regulating circuit 31 outputs the optimum common voltage Vcom to a common electrode of the LCD panel 40 in order to prevent the common voltage Vcom from deviating from the optimum potential as a result of dynamic change of the gate-on voltage Vg by the gate voltage regulating circuit 32.

Figure 2:
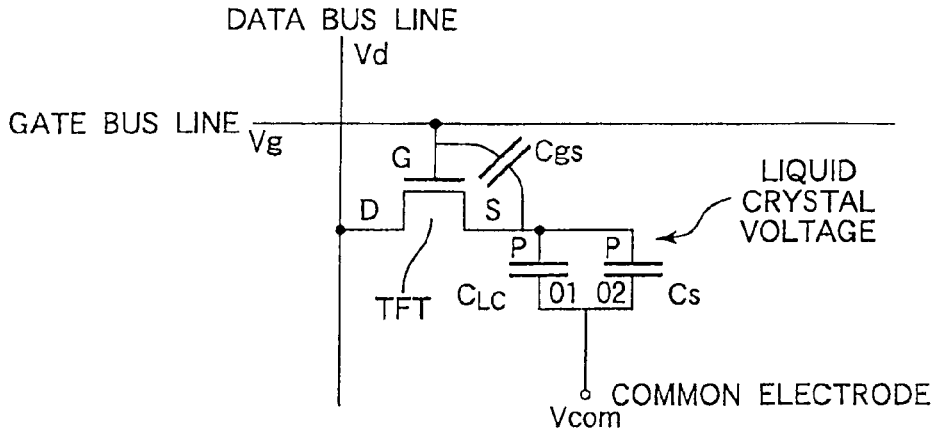
FIG. 2 is a view showing an equivalent circuit of one pixel of the liquid crystal display device according to the first embodiment of the invention.

That the optimum common voltage Vcom is changed in accordance with the change of the gate-on voltage Vg will be described with reference to FIG. 2. FIG. 2 shows an equivalent circuit of a pixel formed in the LCD panel 40. A gate electrode G of a TFT is connected to the gate bus line, and a drain electrode D of the TFT is connected to the data bus line. A source electrode S of the TFT is connected to a pixel electrode P. A liquid crystal is sealed between the pixel electrode P and a common electrode O1 to which the common voltage Vcom is applied and a liquid crystal capacitance $C_{LC}$ is formed. Besides, the pixel electrode P and a storage capacitor electrode O2 which is opposite to the pixel electrode through a not-shown insulating film and to which the common voltage Vcom is applied form a storage capacitor Cs connected in parallel to the liquid crystal capacitance $C_{LC}$. Besides, a parasitic capacitance Cgs is formed between the gate electrode G and the source electrode S of the TFT. It is assumed that with respect to the gate voltage on the gate bus line, its voltage at the time when the gate pulse is off is 0 V, and its voltage (gate-on voltage) at the time when the gate pulse is on is Vg. A gradation voltage Vd is applied to the data bus line. A voltage applied to the liquid crystal will be called a liquid crystal voltage.

Figure 3:
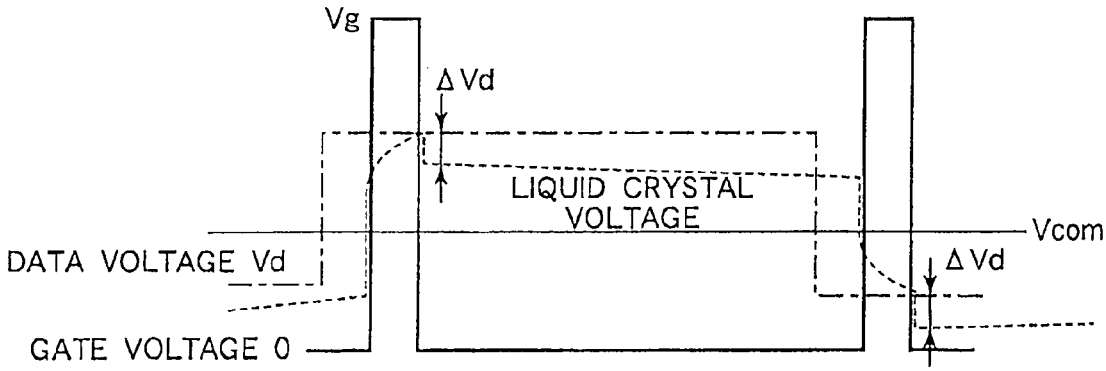
FIG. 3 is a view showing an example of a drive waveform of the liquid crystal display device according to the first embodiment of the invention.

FIG. 3 shows a change of the liquid crystal voltage in the case where the gate-on voltage Vg and the gradation voltage Vd are applied to the equivalent circuit as stated above. In FIG. 3, the waveform of the gate voltage applied to the gate bus line is indicated by a solid line, and the waveform of the gradation voltage Vd applied to the data bus line is indicated by an alternate long and short dash line. Besides, the waveform of the liquid crystal voltage is expressed by a dotted line. As shown in FIG. 3, the waveform of the gate voltage becomes a gate pulse of a rectangular wave which has the gate-on voltage=Vg only in a predetermined period of time at every vertical period. Here, when the waveform of the gradation voltage Vd is expressed by the alternate long and short dash line of FIG. 3, although the liquid crystal voltage is raised in accordance with the gradation voltage Vd during the application of the gate pulse, as electric charge is stored in the liquid crystal capacitance $C_{LC}$ and the storage capacitor Cs, the rise becomes gentle. Besides, at the instant when the gate voltage is lowered from Vg to 0 V, the electric charge is re-distributed to the liquid crystal capacitance $C_{LC}$, the storage capacitor Cs and the parasitic capacitance Cgs, respectively, so that the liquid crystal voltage is lowered by a punch-through voltage ΔVd. The punch-through voltage ΔVd is expressed by the following expression.

$$\Delta Vd=\{Cgs/(Cgs+C_{LC}+CS)\}\times Vg$$

Besides, when the gradation voltage Vd is lowered, the liquid crystal voltage is also lowered in accordance with that, however, when the gate-on voltage is raised from 0 V to Vg, since the electric charge is stored in the liquid crystal capacitance $C_{LC}$ and the storage capacitors Cs and Cgs, the lowering becomes gentle. Besides, at the instant when the gate-on voltage is lowered from Vg to 0 V, the electric charge is re-distributed to the liquid crystal capacitance $C_{LC}$, the storage capacitor Cs and the parasitic capacitance Cgs, so that it is again lowered by the punch-through voltage ΔVd.

With respect to the common voltage Vcom, the center value between positive and negative voltages after it is changed by the punch-through voltage ΔVd becomes optimum, however, when the gate-on voltage Vg is changed in the foregoing expression, the punch-through voltage ΔVd is also changed, and as a result, the optimum value of the common voltage is also changed. Accordingly, as described above, in the case where the gate-on voltage Vg is changed by the horizontal scanning frequency or the vertical scanning frequency, it is required to be regulated to the optimum common voltage Vcom after regulation of the gate-on voltage Vg. As shown in FIG. 3, when the gate-on voltage Vg is made relatively high, the punch-through voltage ΔVd becomes relatively high, and the liquid crystal voltage is lowered, and therefore, the common voltage Vcom is regulated to a lower value.

Figure 4:
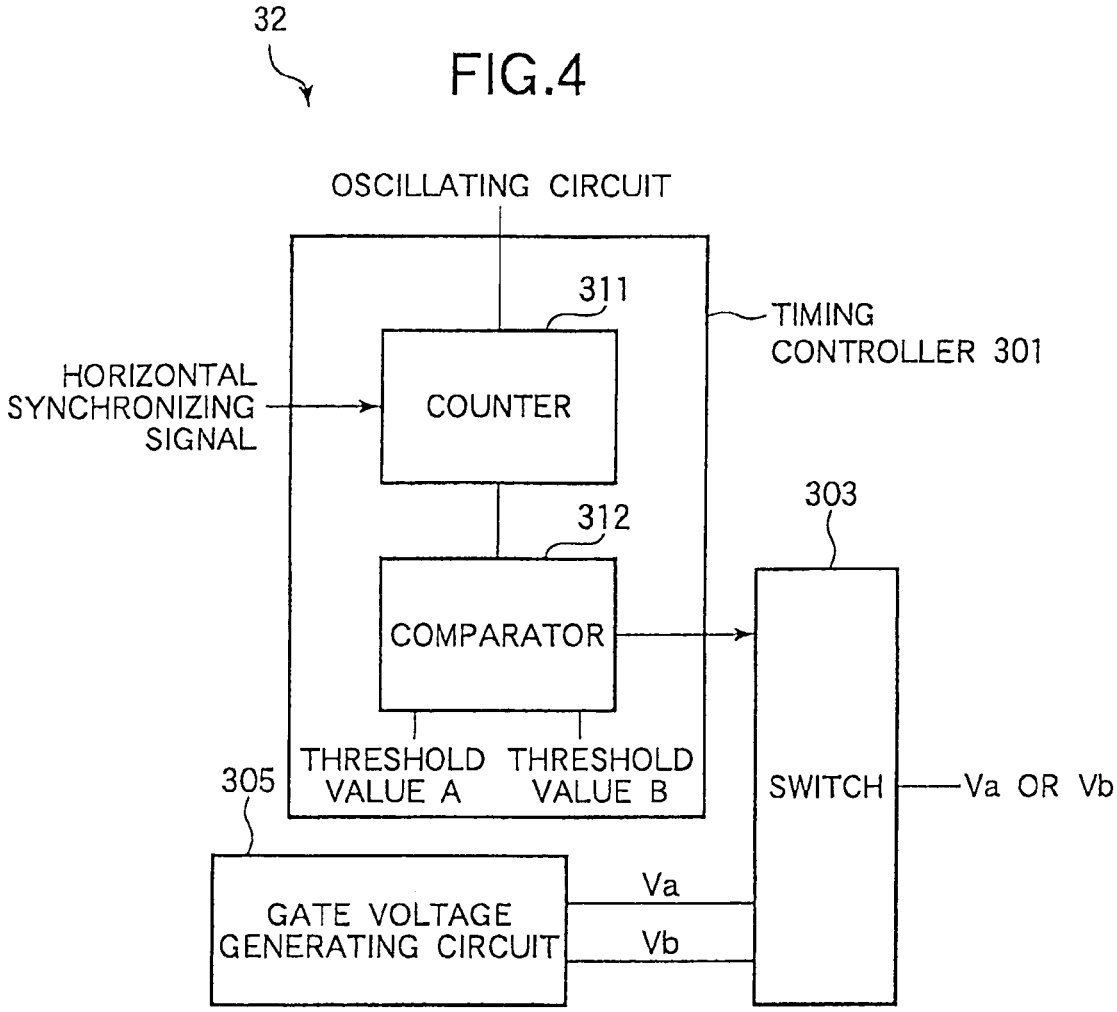
FIG. 4 is a circuit block diagram showing a gate voltage regulating circuit of the liquid crystal display device according to the first embodiment of the invention.

FIG. 4 shows a structural example of the gate voltage regulating circuit 32. The gate voltage regulating circuit 32 includes a timing controller 301 for detecting the change of the horizontal scanning frequency, a gate-on voltage generating circuit 305 for generating two kinds of gate-on voltages Va and Vb (Va<Vb), and a switch 303 for outputting one of the gate-on voltages Va and Vb from the gate-on voltage generating circuit 305 in accordance with the output of the timing controller 301.

The timing controller 301 includes a counter 311 to which a horizontal synchronizing signal and a clock signal from an oscillating circuit are inputted and which counts clocks of one horizontal period, and a comparator 312 to which a count result of the counter 311 and a threshold value A and a threshold value B are inputted and which compares the count result with the threshold value A or the threshold value B. Incidentally, the oscillating circuit generates the clock signal of, for example, 5 MHz. Besides, it is assumed that the gate-on voltage Va is 25 V and the gate-on voltage Vb is 30 V.

Example 1-1

A driving operation according to an example 1-1 using the gate voltage regulating circuit 32 shown in FIG. 4 will be described with reference to FIG. 5. Incidentally, in this example, only one threshold value A is used as the threshold value to be inputted to the comparator 312, and it is assumed that initially, the switch 303 selects and outputs the gate-on voltage Va. The counter 311 counts the clocks from the oscillating circuit until the synchronizing pulse of the horizontal synchronizing signal is detected (steps S1 and S3). For example, in case the horizontal scanning frequency is 50 kHz, when the count value becomes 100 (=5 M/50 k), the synchronizing pulse of the horizontal synchronizing signal is detected. When the synchronizing pulse of the horizontal synchronizing signal is detected, the comparator 312 compares the count value with the threshold value A (step S5). For example, when the threshold value A is made 77, because of the count value (100)>the threshold value A (77), the comparator 312 outputs the control signal to the switch 303 so that the gate-on voltage Va is outputted, and the switch 303 outputs the gate-on voltage Va (step S7). Next, the count value of the counter 311 is cleared (step S11), and until it becomes unnecessary to output the gate-on voltage Vg because of power-off or the like (step S13), the counter 311 counts the clocks from the oscillating circuit until the synchronizing pulse of the horizontal synchronizing signal is again detected (step S1 and S3).

For example, when the horizontal scanning frequency becomes 65 KHz or higher, the count value becomes less than 77 (=5M/65 k). The comparator 312 compares the count value with the threshold value A and judges that the count value is less than the threshold value A, and outputs the control signal to the switch 303 so that the gate-on voltage Vb is outputted. By this, the switch 303 outputs the gate-on voltage Vb (step S9). Next, the counter 311 clears the count value (step S11), and returns to steps S1 and S3 to count the clocks from the oscillating circuit until it becomes unnecessary to output the gate-on voltage Vg.

Figure 5:
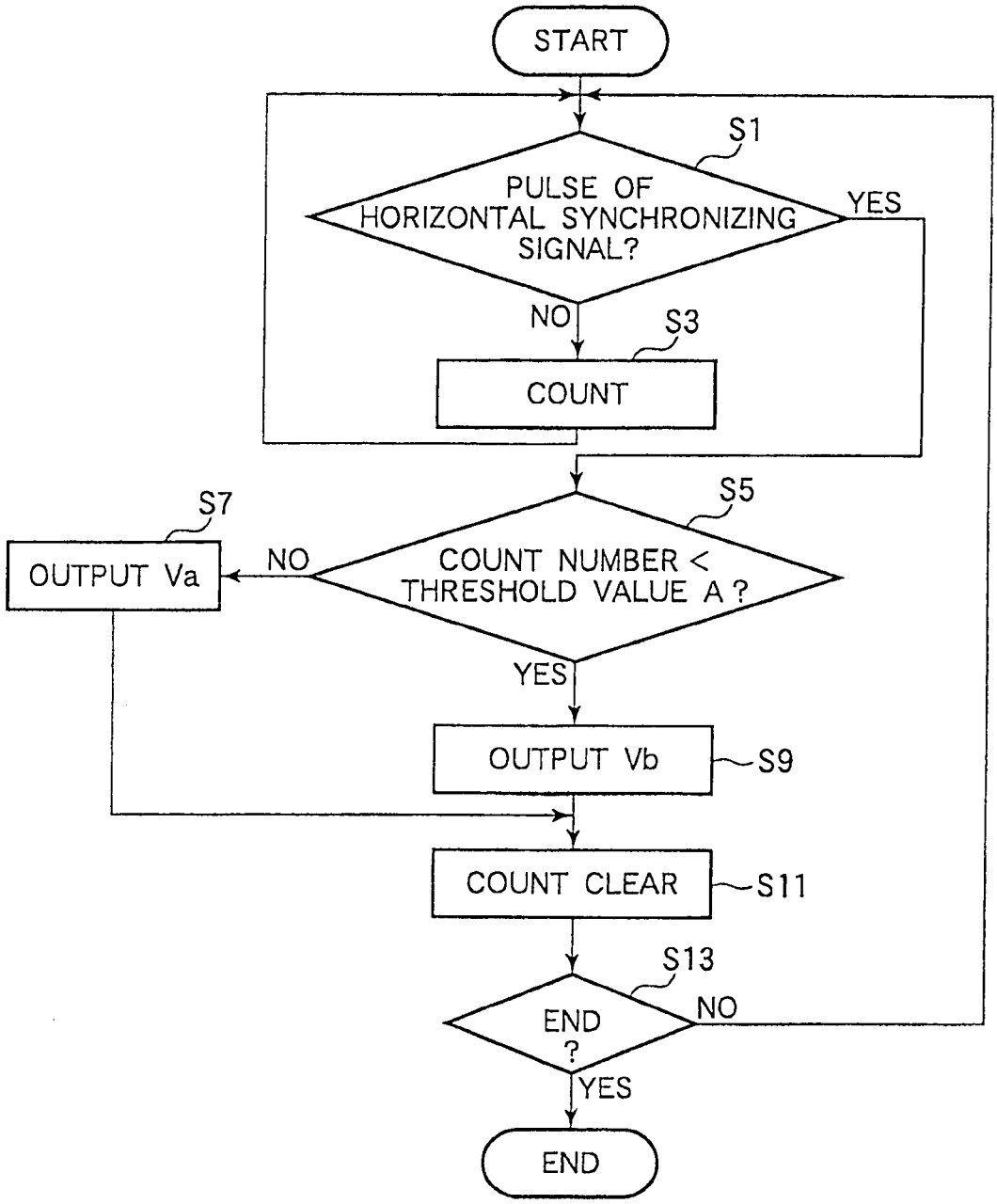
FIG. 5 is an operation flow diagram of the gate voltage regulating circuit of the liquid crystal display device according to an example 1-1 of the first embodiment of the invention.

When the gate voltage regulating circuit 32 performs the driving operation according to the example 1-1 as shown in FIG. 5, in the case where the horizontal scanning frequency is in a normal state, the low gate-on voltage Va is outputted, and in the case where the horizontal scanning frequency exceeds the predetermined threshold value, that is, the count value becomes lower than the threshold value, the high gate-on voltage Vb is outputted. Incidentally, although the example in which the horizontal synchronizing signal is used has been described, the vertical synchronizing signal may be used. In that case, it is necessary to change the value of the threshold value A. Besides, the frequency of the oscillating circuit may be changed.

Not only the structure in which two kinds of gate-on voltages Vg and one kind of threshold value are used as stated above, but also a structure in which for example, three or more kinds of gate-on voltages Vg and two or more kinds of threshold values are used may be naturally adopted. For example, it is also possible to adopt such a structure that in the case where the count value exceeds the threshold value A, the gate-on voltage Va is outputted, in the case where it is less than the threshold value A and exceeds the threshold value B, the gate-on voltage Vb is outputted, and in the case where it is less than the threshold value B, a gate-on voltage Vc is outputted.

Example 1-2

Next, a driving operation according to an example 1-2 of the gate voltage regulating circuit 32 shown in FIG. 4 will be described with reference to FIG. 6. Incidentally, similarly to the example 1-1, it is assumed that initially, the switch 303 outputs the gate-on voltage Va. However, in this example, it is assumed that the threshold value A and the threshold value B are inputted to the comparator 312. The counter 311 counts the clocks from the oscillating circuit until the synchronizing pulse of the horizontal synchronizing signal is detected (steps S21 and S23). For example, if the horizontal scanning frequency is 50 kHz, when the count value becomes 100, the synchronizing pulse of the horizontal scanning frequency is detected. When the synchronizing pulse of the horizontal synchronizing signal is detected, the comparator 312 compares the count value with the threshold value A (step S25). For example, when the threshold value A is made 77, because of the count value (100)>the threshold value A (77), the comparator 312 outputs the control signal to the switch 303 so that the gate-on voltage Va is outputted, and the switch 303 outputs the gate-on voltage Va (step S27). Next, until it becomes unnecessary to output the gate-on voltage Vg because of power-off or the like (step S29), the counter 311 clears the count value (step S31) and counts the clocks from the oscillating circuit until the synchronizing pulse of the horizontal synchronizing signal is again detected (steps S21 and S23).

For example, if the horizontal scanning frequency becomes 65 kHz or higher, the count value becomes lower than 77. The comparator 312 compares the count value with the threshold value A and judges that the count value is less than the threshold value A, and outputs the control signal to the switch 303 so that the gate-on voltage Vb is outputted. By this, the switch 303 outputs the gate-on voltage Vb (step S33). Next, the counter 311 clears the count value (step S35). Next, until it becomes unnecessary to output the gate-on voltage Vg (step S37), the counter 311 counts the clocks from the oscillating circuit until the synchronizing pulse of the horizontal synchronizing signal is detected (steps S39 and S41). For example, if the horizontal scanning frequency is not changed, the count value is less than 77 and the synchronizing pulse of the horizontal synchronizing signal is detected. Then, the comparator 312 compares the count value with the threshold value B (step S43). For example, when the threshold value B is 82, because of the count value<the threshold value B, the procedure returns to the step S33, the comparator 312 outputs the control signal to the switch 303 so that the gate-on voltage Vb is outputted, and the switch 303 outputs the gate-on voltage Vb (step S33).

Next, the counter 311 clears the count (step S35). Then, as long as the necessity to output the gate-on voltage does not disappear (step S37), the counter 311 counts the clocks from the oscillating circuit until the synchronizing pulse of the horizontal synchronizing signal is detected (steps S39 and S41). Here, for example, when the horizontal scanning frequency is changed to 60 kHz, the count value becomes 83 (=5 M/60 k), and the synchronizing pulse of the horizontal synchronizing signal is detected. The comparator 312 compares the count value with the threshold value B (step S43). Because of the count value>threshold value B, the procedure returns to the step S27, the comparator 312 outputs the control signal to the switch 303 so that the gate-on voltage Va is outputted, and the switch 303 outputs the gate-on voltage Va (step S27).

Then, until it becomes unnecessary to output the gate-on voltage Vg because of power-off or the like (step S29), the counter 311 clears the count value (step S31), and counts the clocks from the oscillating circuit until the synchronizing pulse of the horizontal synchronizing signal is again detected (steps S21 and S23).

For example, if the horizontal scanning frequency remains 60 kHz, the count value is 83 and the synchronizing pulse of the horizontal synchronizing signal is detected. The comparator 312 compares the count value with the threshold value A (step S25). When the threshold value A is 77, because of the count value (83)>the threshold value A (77), the comparator 312 outputs the control signal to the switch 303 so that the gate-on voltage Va is outputted, and the switch 303 outputs the gate-on voltage Va (step S27). Then, until it becomes unnecessary to output the gate-on voltage because of power-off or the like (step S29), the counter 311 clears the count value (step S31), and counts the clocks from the oscillating circuit until the synchronizing pulse of the horizontal scanning frequency is again detected (step S21 and S23). Such an operation is repeated.

Figure 6:
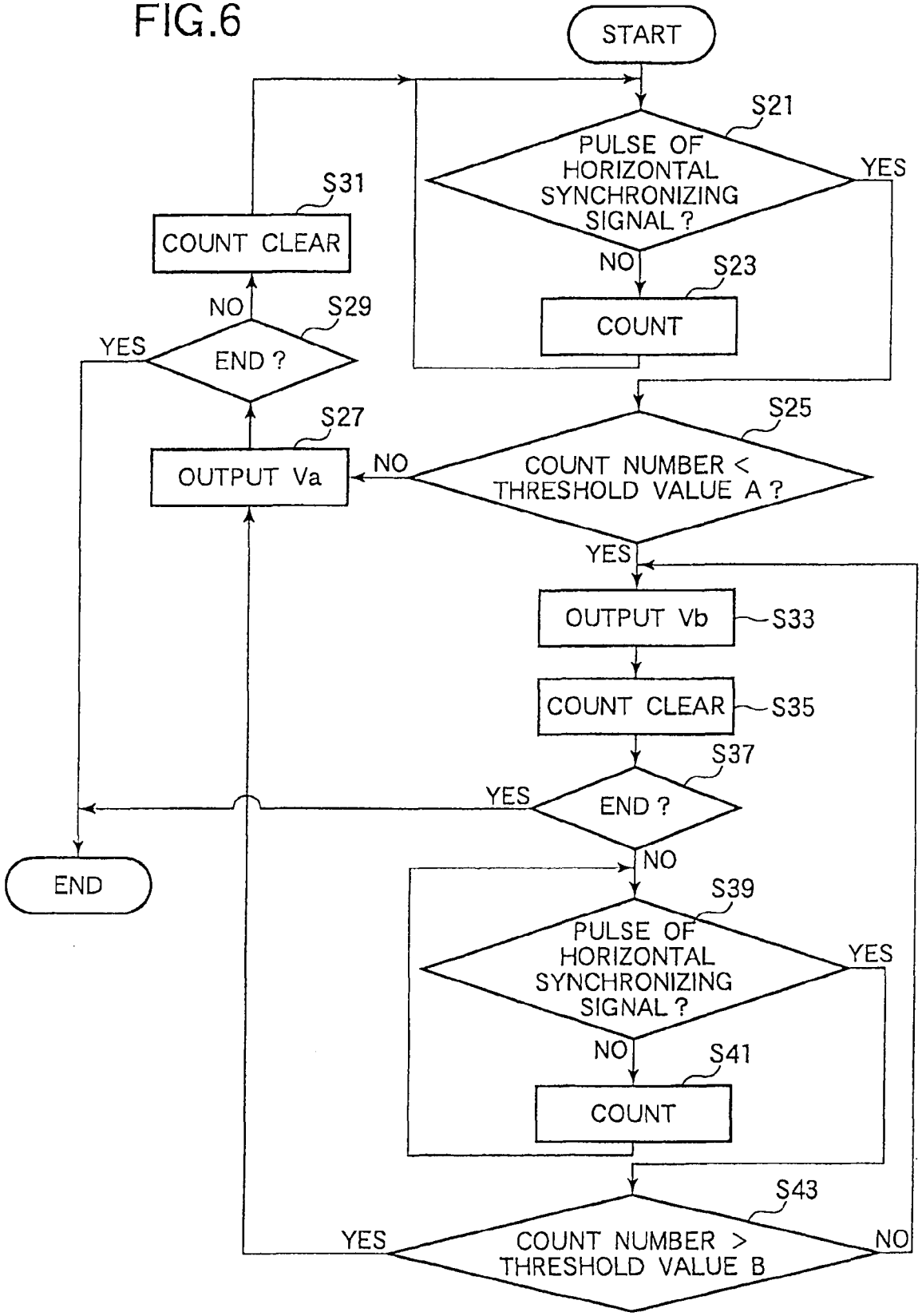
FIG. 6 is an operation flow diagram of the gate voltage regulating circuit of the liquid crystal display device according to an example 1-2 of the first embodiment of the invention.

By doing so, when the gate voltage regulating circuit 32 performs the driving operation according to the example 1-2 as shown in FIG. 6, in the case where the horizontal scanning frequency is in the normal state, the low gate-on voltage Va is outputted, and in the case where the horizontal scanning frequency exceeds the first threshold value, that is, the count value falls below the threshold value A, the high gate-on voltage Vb is outputted. However, in the case where the horizontal scanning frequency becomes low again, and becomes lower than the second threshold value, that is, the count value becomes larger than the threshold value B, the low gate-on voltage Va is outputted. For example, in the case where the horizontal scanning frequency or the count value fluctuates in the vicinity of the first threshold value, or in the case where a fraction occurs in the count value by the frequency of the oscillating circuit, if a judgment is made with only one threshold value, there can occur a case where the change of the gate-on voltage is repeated. As stated above, when the judgment is made with the two threshold values, in the case where the horizontal scanning frequency or the count value fluctuates in the vicinity of the first threshold value, or even in the case where the fraction occurs in the count value by the frequency of the oscillating circuit, the change of the gate-on voltage is not repeated, and only in the case where the horizontal scanning frequency is actually changed, the gate-on voltage is changed.

Example 1-3

Figure 7A:
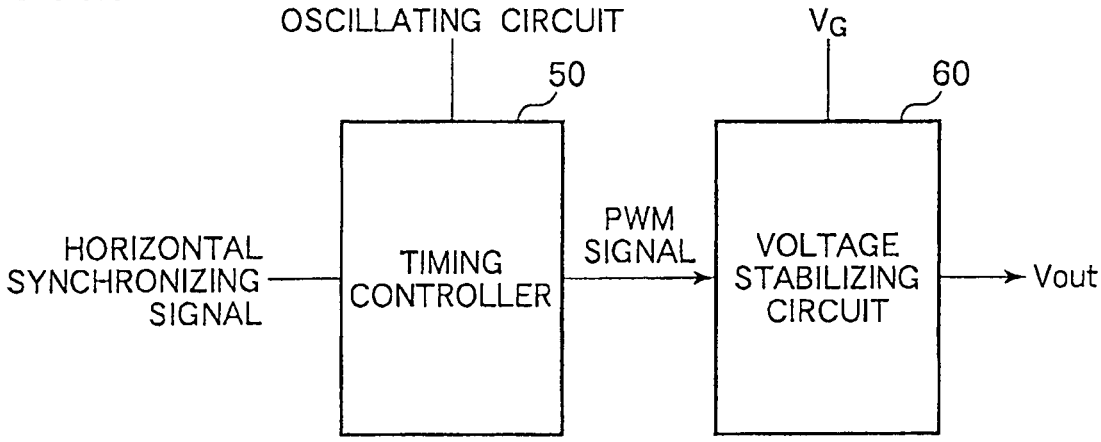
FIGS. 7A to 7C are views showing a gate voltage regulating circuit of the liquid crystal display device according to the first embodiment of the invention.

Next, an example 1-3 will be described with reference to FIGS. 7A to 7C. In the example 1-1 and the example 1-2, the gate-on voltage Vg is changed stepwise, however, it can also be changed continuously, not necessarily changed stepwise. In the example 1-3, as shown in FIG. 7A, the gate voltage regulating circuit 32 is constituted by a timing controller 50 to which a horizontal synchronizing signal and a clock signal from an oscillating circuit are inputted and which generates a PWM (Pulse Width Modulation) signal having a duty ratio corresponding to a horizontal period, and a voltage stabilizing circuit 60 to which a voltage $V_G$ and the PWM signal are inputted and which generates a voltage Vout in accordance with the duty ratio of the PWM signal.

Figure 7B:
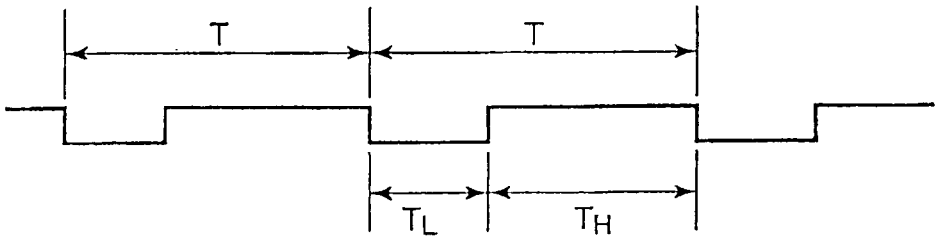

In the case of the PWM signal as shown in FIG. 7B, the duty ratio is expressed by a ratio $T_H/T$ of a period $T_H$ of an "H" level to a period T. Accordingly, when the horizontal scanning frequency becomes high, that is, the count value of the clocks of the oscillating circuit becomes low, the timing controller 50 makes, for example, the period $T_L$ of the "L" level short and the period $T_H$ of the "H" level long. On the contrary, when the horizontal scanning frequency becomes low, that is, the count value of the clocks of the oscillating circuit becomes large, for example, the period $T_L$ of the "L" level is made long, and the period $T_H$ of the "H" level is made short.

Figure 7C:
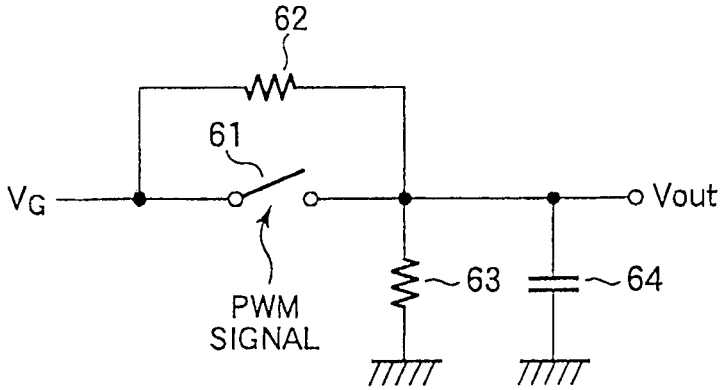

The voltage stabilizing circuit 60 uses the voltage $V_G$ to linearly generate the gate-on voltage in accordance with the PWM signal having the duty ratio corresponding to the horizontal scanning frequency, and is, for example, a circuit as shown in FIG. 7C. That is, there are included a switch 61 which is brought into the on state, for example, only in the period $T_H$ of the "H" level of the PWM signal, a resistor 62, a resistor 63 and a capacitor 64. The switch 61 is disposed between an output end of the voltage $V_G$ and one end of the resistor 63. The resistor 62 is disposed in parallel to the switch 61, and one end thereof is connected to the output end of the voltage $V_G$ and the other end is connected to a connection point between the switch 61 and the resistor 63. The other end of the resistor 63 is grounded. One end of the capacitor 64 is also connected to the connection point between the switch 61 and the resistor 63, and the other end is grounded. The gate-on voltage Vout is extracted from the connection point.

When the resistance values of the resistor 62 and the resistor 63 and the capacitance value of the capacitor 64 are suitably set, and the switch 61 is made to have the on state only in, for example, the period $T_H$ of the "H" level of the PWM signal, the suitable gate-on voltage Vout corresponding to the horizontal scanning frequency is generated. In the case where the horizontal scanning frequency is linearly changed, the gate-on voltage Vout is also linearly changed. When such a structure is adopted, the optimum gate-on voltage corresponding to the horizontal scanning frequency can be always supplied to the gate driver 20. Incidentally, not the horizontal synchronizing signal, but the vertical synchronizing signal may be used. Besides, the circuit example of the voltage stabilizing circuit 60 of FIG. 7C is an example, and another structure may be adopted.

A circuit structure of the common voltage regulating circuit 31 is almost similar to the gate voltage regulating circuit 32. In the gate voltage regulating circuit 32, when the vertical scanning frequency or the horizontal scanning frequency becomes high, the gate-on voltage Vg is raised, however, in the common voltage regulating circuit 31, when the vertical scanning frequency or the horizontal scanning frequency becomes high, the common voltage Vcom is made low.

Example 1-4

Figure 8A:
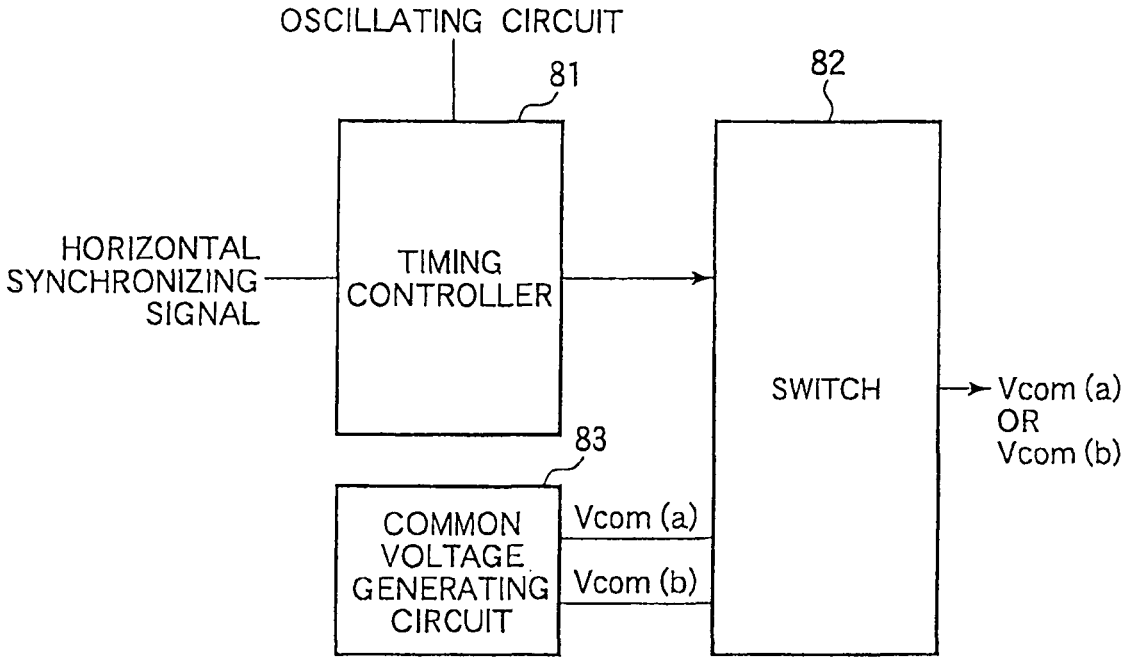
FIGS. 8A and 8B are views showing a common voltage regulating circuit of the liquid crystal display device according to the first embodiment of the invention.

FIG. 8A shows an example of the common voltage regulating circuit 31. The common voltage regulating circuit 31 includes a timing controller 81 to which a clock signal from an oscillating circuit and a horizontal synchronizing signal are inputted and which detects a change of a horizontal scanning frequency. Besides, the common voltage regulating circuit 31 includes a common voltage generating circuit 83 for generating two kinds of common voltages Vcom(a) and Vcom(b) (Vcom(a)>Vcom(b)), and a switch 82 for outputting one of the common voltages Vcom(a) and Vcom(b) from the common voltage generating circuit 83 in accordance with the output of the timing controller 81. Although not shown, the timing controller 81 includes a counter for counting clocks of one horizontal period, and a comparator to which a count result of the counter, a threshold value A and a threshold value B are inputted and which compares the count result with the threshold value A or the threshold value B. The frequency of the clock signal of the oscillating circuit and the values of the threshold value A and the threshold value B are made the same as those of the timing controller 301 of the gate voltage regulating circuit 32. However, because of Vcom(a)>Vcom (b), in the state where the horizontal scanning frequency is normal, Vcom(a) is outputted, and as the horizontal scanning frequency becomes high, Vcom(b) is outputted. Although the operation of FIG. 8A is substantially the same as FIGS. 5 and 6, in the case where the gate-on voltage Va is outputted, the common voltage Vcom(a) is outputted, and in the case where the gate-on voltage Vb is outputted, the common voltage Vcom(b) is outputted.

Example 1-5

Figure 8B:
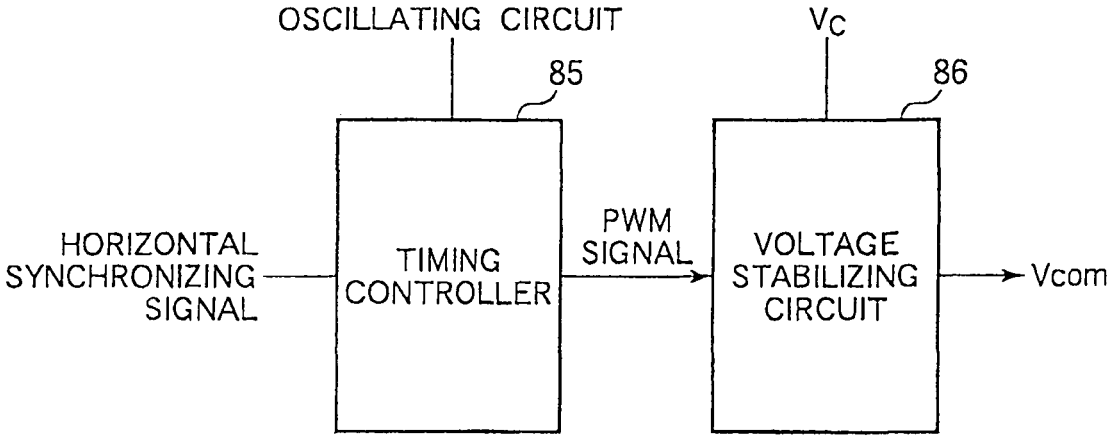

Next, FIG. 8B shows another example of the common voltage regulating circuit 31. The common voltage can also be changed linearly, not changed stepwise. In this example, as shown in FIG. 8B, the common voltage regulating circuit 31 is constituted by a timing controller 85 to which a horizontal synchronizing signal and a clock signal from an oscillating circuit are inputted and which generates a PWM signal having a duty ratio corresponding to a horizontal period, and a voltage stabilizing circuit 86 to which a voltage Vc and the PWM signal are inputted and which generates a voltage Vcom in accordance with the duty ratio of the PWM signal. When the horizontal scanning frequency becomes high, that is, the count of the clocks of the oscillating circuit becomes low, the timing controller 85 makes, for example, the period $T_H$ of the "H" level short and the period T of the "L" level long. On the contrary, when the horizontal scanning frequency becomes low, that is, the count of the clocks of the oscillating circuit becomes large, for example, the period $T_H$ of the "H" level is made long and the period T of the "L" level is made short. Then, by using a switch which is brought into the on state only in, for example, the period $T_H$ of the "H" level of the PWM signal, the common voltage Vcom is linearly changed in such a manner that when the horizontal scanning frequency becomes high, the common voltage Vcom becomes low, and on the contrary, when it becomes low, the common voltage Vcom becomes high.

Example 1-6

Figure 9:
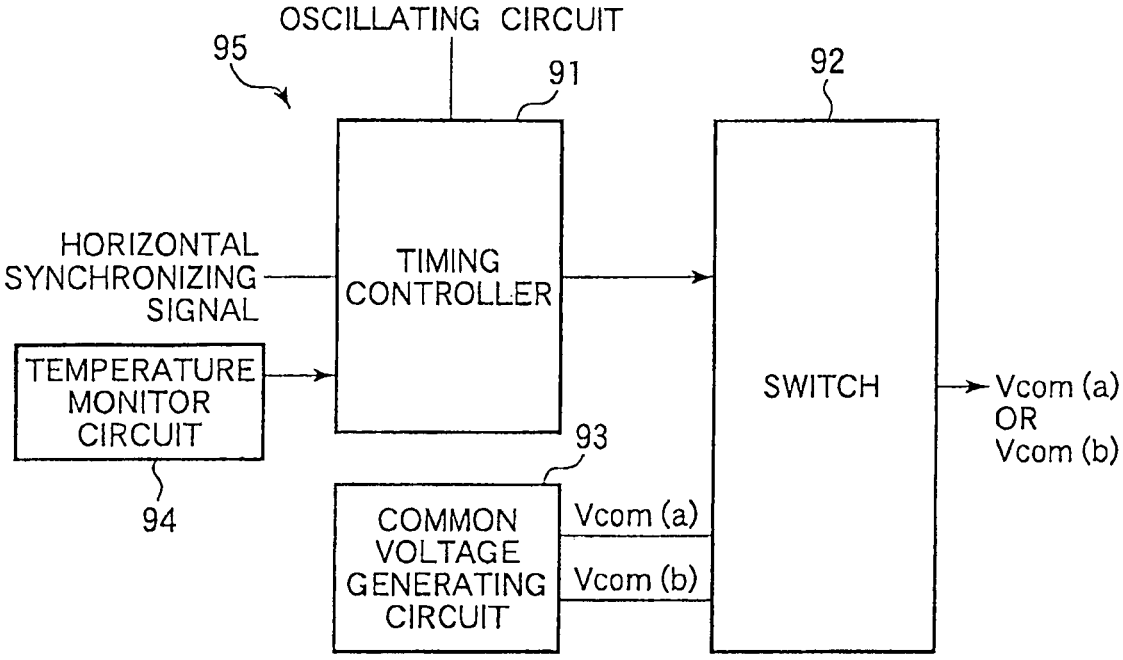
FIG. 9 is a view showing a common voltage regulating circuit of the liquid crystal display device according to an example 1-6 of the first embodiment of the invention.

Next, FIG. 9 shows a still another example of the common voltage regulating circuit 31. A common voltage regulating circuit 95 of this example is characterized in that a temperature monitor circuit 94 is further provided in addition to the common voltage regulating circuit 31. The temperature monitor circuit 94 detects ambient temperature of a liquid crystal display device, converts the temperature information into a digital signal, and outputs it to a timing controller 91. Although not shown, the timing controller 91 stores a threshold value g and a threshold value h (threshold value g>threshold value h), and includes a comparator for comparing a detected temperature t detected by the temperature monitor circuit 94 with the threshold value g, h. The timing controller 91 outputs a control signal on the basis of a difference between the detected temperature t and the threshold value g, h and controls a changeover of a switch 92. Two kinds of common voltages Vcom(a) and Vcom(b) (Vcom(a)>Vcom (b)) generated by a common voltage generation circuit 93 are inputted to the switch 92, and one of the common voltages is supplied to a common electrode on the basis of the control signal. It is assumed that the common voltage Vcom(a) is outputted in the initial state (at turn-on) of the common voltage regulating circuit 95.

Next, the operation of the common voltage regulating circuit 95 will be described. When the common voltage Vcom(a) is outputted, the common voltage regulating circuit 95 compares the detected temperature t with the smaller threshold value (threshold value h in this example), and when the common voltage Vcom(b) is outputted, it compares the detected temperature t with the larger threshold value (threshold value g in this example). By doing so, it is possible to prevent a so-called oscillation phenomenon in which when the detected temperature t indicates a value close to a threshold value, the common voltage is sensitively changed between Vcom(a) and Vcom(b). In the initial state (common voltage Vcom(a) is outputted) of the common voltage regulating circuit 95, in the case where the detected temperature t is larger than the threshold value h, the common voltage Vcom(a) is kept outputted. On the other hand, in the case where the detected temperature t is lower than the threshold value h, the switch 92 is changed to output the common voltage Vcom(b). In the state where the common voltage regulating circuit 95 outputs the common voltage Vcom(b), in the case where the detected temperature t is lower than the threshold value g, the common voltage Vcom(b) is kept outputted. On the other hand, in the case where the detected temperature t is higher than the threshold value g, the switch 92 is changed to output the common voltage Vcom(a).

Besides, a clock signal is inputted to the common voltage regulating circuit 95 from an oscillating circuit, and a horizontal synchronizing signal is inputted from a system side apparatus such as a personal computer. Accordingly, it is also possible to perform such driving to regulate the common voltage Vcom by the clock signal and the horizontal synchronizing signal as described in the examples 1-4 and the like. Further, it is also possible to regulate the common voltage Vcom on the basis of the ambient temperature, the clock signal and the horizontal synchronizing signal.

By applying the examples 1-6, it is possible to cope with the following problems. For example, conventionally, the resolution and display density are not so high, and the brightness is also low, and accordingly, in the driving of the liquid crystal, there is an allowance in an opposite electrode voltage variation and liquid crystal writing time, and there is a margin to a flicker phenomenon, called a flicker, due to a liquid crystal driving system and display pattern interference. Thus, an opposite electrode potential generating circuit has been formed of an analog circuit independent of a timing controller.

However, in recent years, the resolution, the display density and the screen size have become remarkably high and wide. When the resolution becomes high, the writing time of the liquid crystal becomes short, and it becomes severe to keep the display data potential and the opposite electrode potential in the optimum state for the respective pixels of the whole screen. Further, today, it is essential to improve the performance by raising the brightness of the liquid crystal display device, which is a primary factor that causes the flicker phenomenon to become remarkably noticeable by the deviation of common potential. As a resolving method, there is a driving method of continuing to correct the opposite electrode potential of a liquid crystal panel to an optimum state at all times. However, under various conditions of ambient circumstances of the display device, frequencies of data signals inputted to the display device, and the like, there is a limit in the opposite electrode potential level of the liquid crystal panel regulated at the time of manufacture and shipment of the display device. In view of such conditions, by using a system in which the environmental state where the display device itself is used is recognized independently, and this opposite electrode potential can be corrected by an internal circuit, it becomes possible to always supply the display quality of the optimum state.

Second Embodiment

A driving method and a drive control circuit of a liquid crystal display device according to a second embodiment of the invention and a liquid crystal display device including the same will be described with reference to FIGS. 10 to 15. An analog picture signal transmitted from a system side apparatus such as a personal computer is converted into a digital signal by an analog/digital converting circuit (A/D converter) as one of components constituting a drive control circuit of a liquid crystal display device, and is inputted to a source driver IC (Integrated Circuit) for driving a liquid crystal. Contrast adjustment of a display screen of the liquid crystal display device is performed by the setting of gain adjustment and the like of the A/D converter. Besides, in general, a drive voltage of the liquid crystal display device is fixed.

Figure 13A:
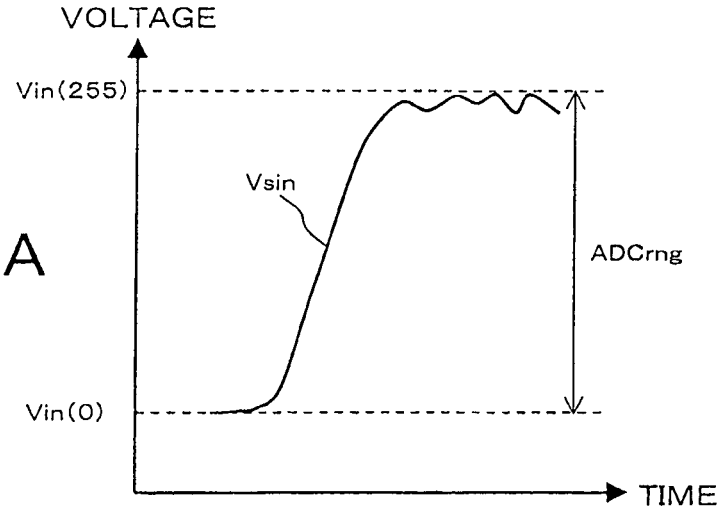
FIGS. 13A to 13C are views for explaining a conventional contrast adjustment method and showing picture signal waveforms inputted to a liquid crystal display device from a system side apparatus such as a personal computer.
Figure 13B:
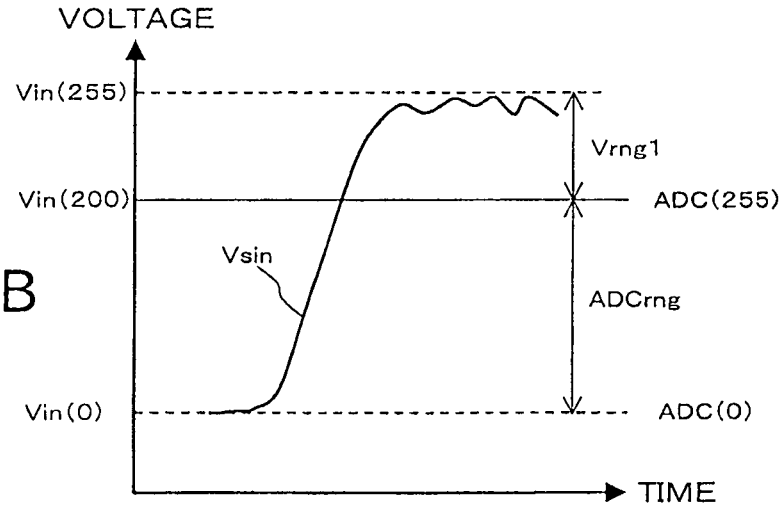
Figure 13C:
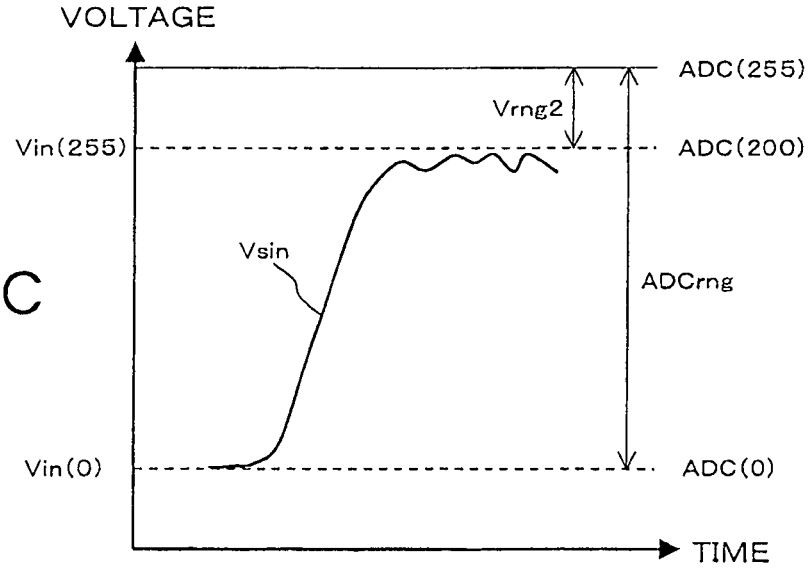

Incidentally, in recent years, the display quality of the liquid crystal display device has become very important. Since a conventional contrast adjustment is a method of adjusting a gain of an A/D converter, there is a problem that if deviation from the optimum setting occurs, the number of colors is decreased and the display quality is degraded. FIGS. 13A to 13C are views for explaining the conventional contrast adjusting method, and are views showing picture signal waveforms inputted from a system side apparatus such as a personal computer to a liquid crystal display device. The picture signal waveform is an input analog signal Vsin of 8-bit resolution. In FIGS. 13A to 13C, the horizontal axis indicates the input time of the input analog signal Vsin, and the vertical axis indicates the voltage value. FIG. 13A shows a state in which a full scale range of O-gradation to 255-gradation voltage of the input analog signal Vsin is coincident with a full scale range ADCrng of voltage of an analog receiver part of the A/D converter. This state is the optimum setting, and the liquid crystal display device can faithfully display an image of the input analog signal Vsin.

FIG. 13B shows the input analog signal Vsin in the case where the contrast is made high. The gain of the A/D converter is adjusted, and a setting is made such that the full scale range ADCrng of the A/D converter becomes smaller than the full scale range of the input analog signal. For example, the setting is made such that a voltage Vin(200) of a 200-gradation level of the input analog signal becomes the full scale range ADCrng of the A/D converter. In this case, when the 200-gradation level Vin(200) of the input analog signal Vsin is inputted, a voltage ADC(255) of a 255-gradation level is applied to the liquid crystal, so that the contrast is increased. However, even if a 200-gradation or higher input analog signal Vsin (range of Vrng1) is inputted, only the voltage of the 255-gradation level ADC(255) is applied to the liquid crystal, so that the number of display colors is decreased.

FIG. 13C shows the input analog signal Vsin in the case where the contrast is made low. The setting is made such that the full scale range ADCrng of the A/D converter becomes larger than the full scale range of the input analog signal Vsin by adjusting the gain of the A/D converter. For example, the setting is made such that the voltage Vin(255) of the 255-gradation level of the input analog signal Vsin becomes the 200-gradation level ADC(200) of the A/D converter. In this case, when the 255-gradation level Vin(255) of the input analog signal Vsin is inputted, the voltage ADC(200) of the 200-gradation level is applied to the liquid crystal, so that the contrast is lowered. However, since a voltage (range of Vrng2) larger than the 200-gradation level voltage is not applied to the liquid crystal, the number of display colors is decreased.

Figure 14:
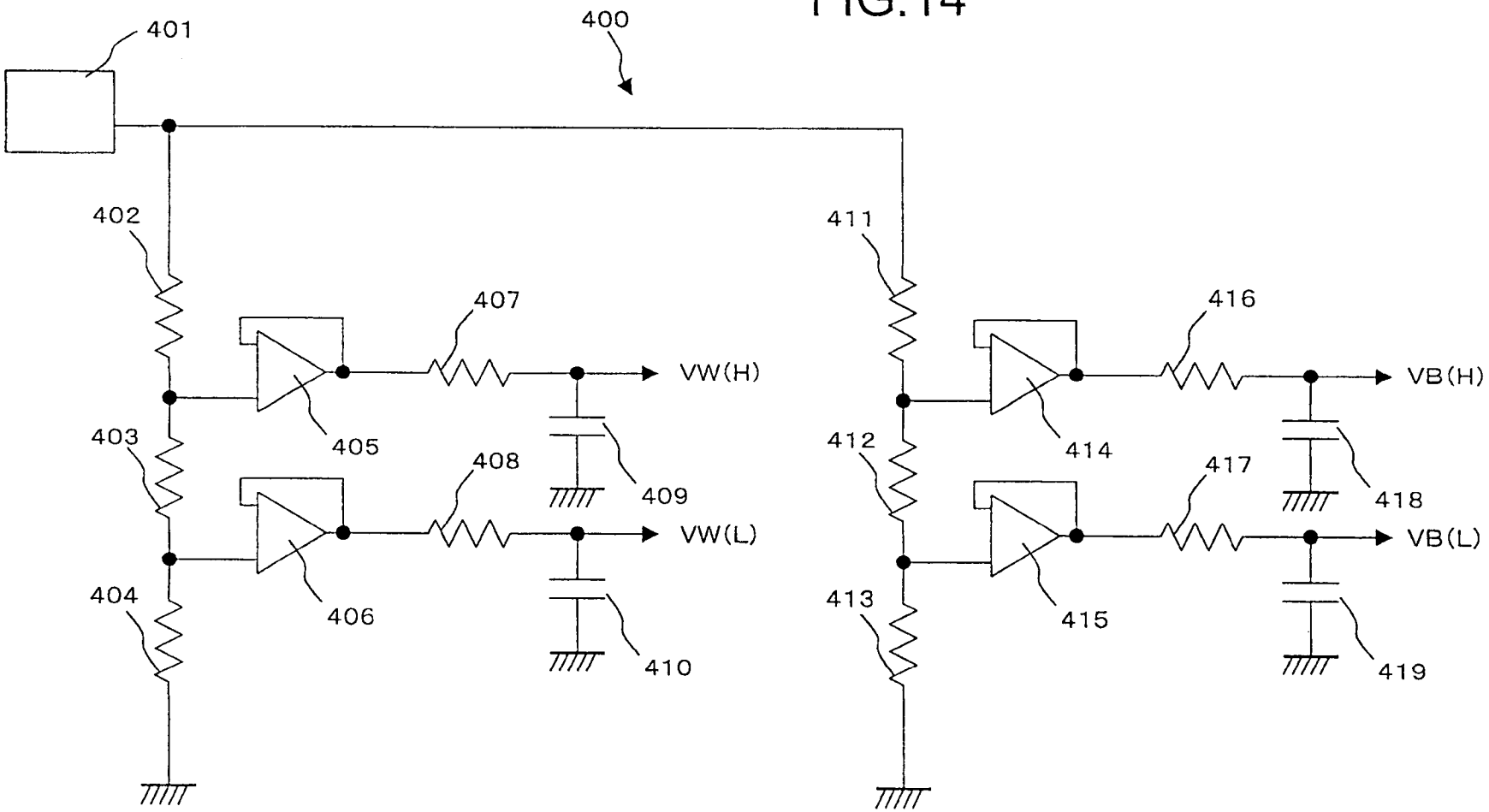
FIG. 14 is a view showing a circuit structure of a conventional reference voltage generating circuit 400.

Besides, even if the setting of the liquid crystal drive voltage is fixed, a gradation characteristic (y characteristic) is changed by manufacture variations and the like in the respective components constituting the drive control circuit. FIG. 14 shows an example of a conventional circuit structure for generating a reference voltage of a liquid crystal applied voltage. The reference voltage generated by the reference voltage generating circuit 400 is a voltage for display of white and black. In the following description, an example of a normally black liquid crystal display device which performs a black display when voltage is not applied to a liquid crystal, will be described. In the normally black, a white display applied voltage (white voltage) VW becomes higher than a black display applied voltage (black voltage) VB. Besides, the liquid crystal display device is required to perform alternating-current driving to a common voltage Vcom, and a voltage side higher than the common voltage Vcom will be called a H side, and a lower voltage side will be called an L side.

Next, a circuit structure of the reference voltage generating circuit 400 will be described. A drive voltage of the reference voltage generating circuit 400 is generated by a power supply circuit 401. An output terminal of the power supply circuit 401 is connected to one terminal of a resistor 402. One terminal of a resistor 403 is connected to the other terminal of the resistor 402. One terminal of a resistor 404 is connected to the other terminal of the resistor 403. The other terminal of the resistor 404 is grounded. One input terminal of an amplifier 405 is connected to a connection terminal between the resistor 402 and the resistor 403. An output terminal of the amplifier 405 is connected to one terminal of a phase compensation resistor 407 and is connected to the other input terminal of the amplifier 405. The other terminal of the resistor 407 is connected to one electrode of a capacitor 409 and one terminals of internal resistances 502 and 504 integrated in after-mentioned source driver ICs 500 and 501 (see FIG. 15). The other electrode of the capacitor 409 is grounded. Besides, one input terminal of an amplifier 406 is connected to a connection terminal between the resistor 403 and the resistor 404. An output terminal of the resistor 406 is connected to one terminal of a phase compensation resistor 408 and is connected to the other input terminal of the amplifier 406. The other terminal of the resistor 408 is connected to one electrode of capacitor 410 and one terminals of internal resistances 503 and 505 of the source driver ICs 500 and 501. The other electrode of the capacitor 410 is grounded.

Further, the output terminal of the power source circuit 401 is connected to one terminal of a resistor 411. One terminal of a resistor 412 is connected to the other terminal of the resistor 411. One terminal of a resistor 413 is connected to the other terminal of the resistor 412. The other terminal of the resistor 413 is grounded. One input terminal of an amplifier 414 is connected to a connection terminal between the resistor 411 and the resistor 412. An output terminal of the amplifier 414 is connected to one terminal of a phase compensation resistor 416 and is connected to the other input terminal of the amplifier 414. The other terminal of the resistor 416 is connected to one electrode of a capacitor 418 and the other terminals of the driver internal resistances 502 and 504 of the source driver ICs 500 and 501. The other electrode of the capacitor 418 is grounded. Besides, one input terminal of an amplifier 415 is connected to a connection terminal between the resistor 412 and the resistor 413. An output terminal of the amplifier 415 is connected to one terminal of a phase compensation resistor 417 and is connected to the other input terminal of the amplifier 415. The other terminal of the resistor 417 is connected to one electrode of a capacitor 419 and the other terminals of the driver internal resistances 503 and 505 of the source driver ICs 500 and 501. The other electrode of the capacitor 419 is grounded.

Next, the operation of the reference voltage generating circuit 400 will be described. Voltages divided at ratios of resistance values of the resistors 402, 403 and 404 connected in series between the power supply circuit 401 and the ground are inputted to the amplifiers 405 and 406. The amplifiers 405 and 406 operate as, for example, voltage followers, and outputs voltages equal to the input voltages of the amplifiers 405 and 406. On the other hand, voltages divided at ratios of resistance values of the resistors 411, 412 and 413 connected in series between the power supply circuit 401 and the ground are inputted to the amplifiers 414 and 415. The amplifiers 414 and 415 operate as, for example, voltage followers, and outputs voltages equal to the input voltages of the amplifiers 414 and 415. In this description, the output voltage of the amplifier 405 is used as an H side white voltage VW(H), the output voltage of the amplifier 406 is used as an L side white voltage VW(L), the output voltage of the amplifier 414 is used as an H side black voltage VB(H), and the output voltage of the amplifier 415 is used as an L side black voltage VB(L).

Figure 15:
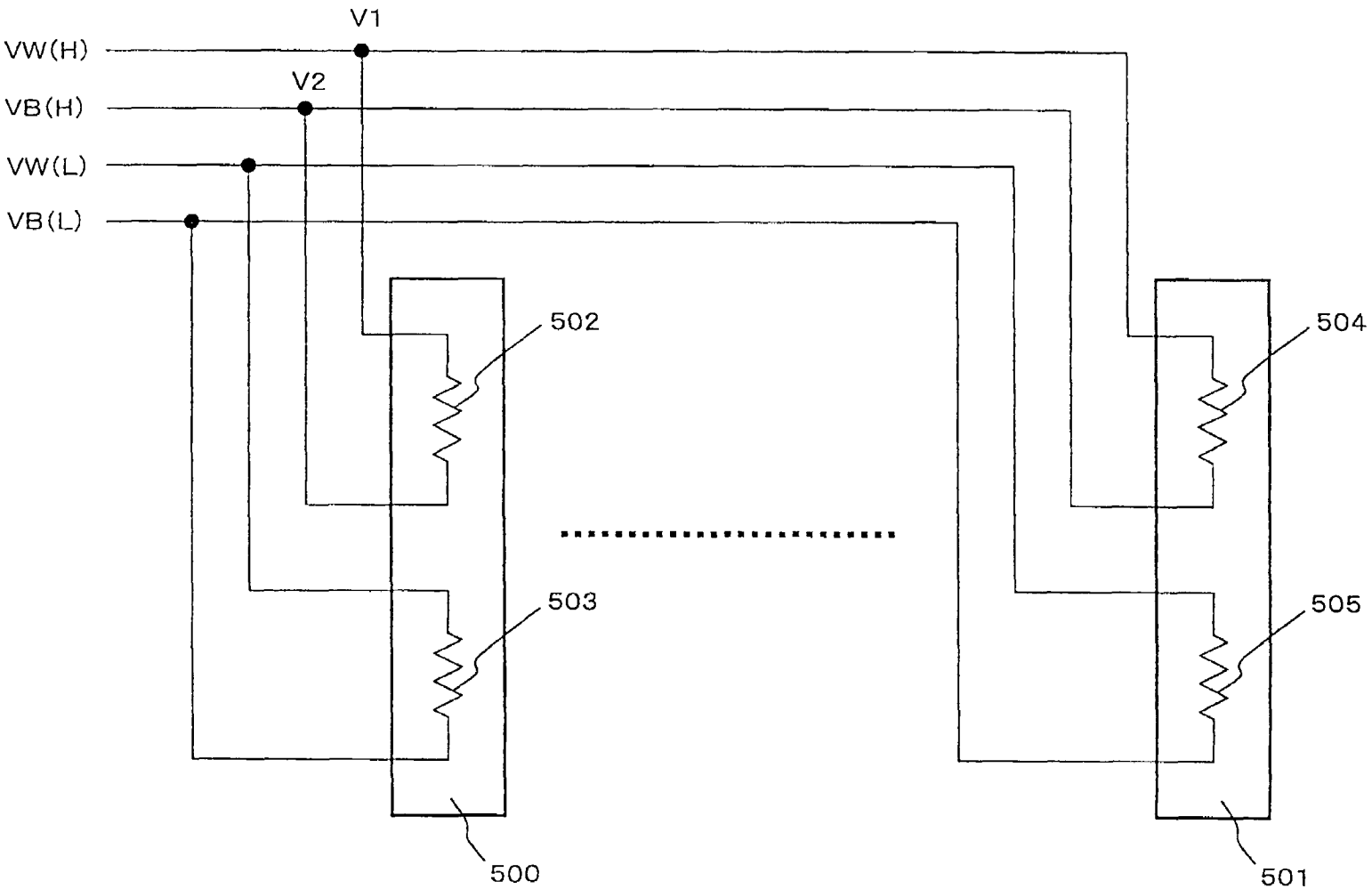
FIG. 15 is a view for explaining connection of the conventional reference voltage generating circuit 400 and source driver ICs 500 and 501.
Figure 16:
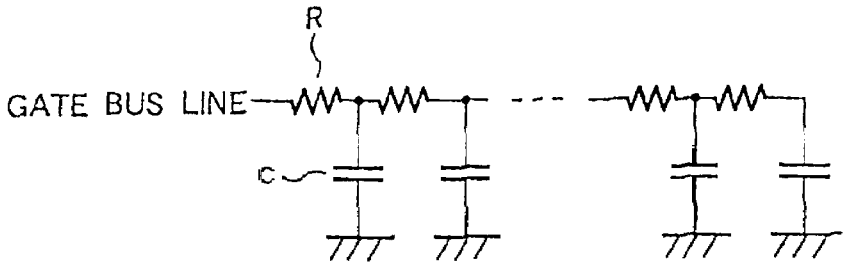
PRIOR ART FIG.16
FIG. 16 is a view showing a gate bus line as a CR distributed constant circuit.
Figure 17:
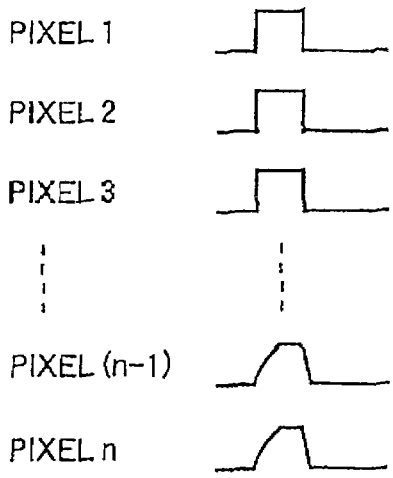
PRIOR ART FIG.17
FIG. 17 is a view showing a state of gate delay of a gate pulse applied to a gate bus line.
Figure 18:
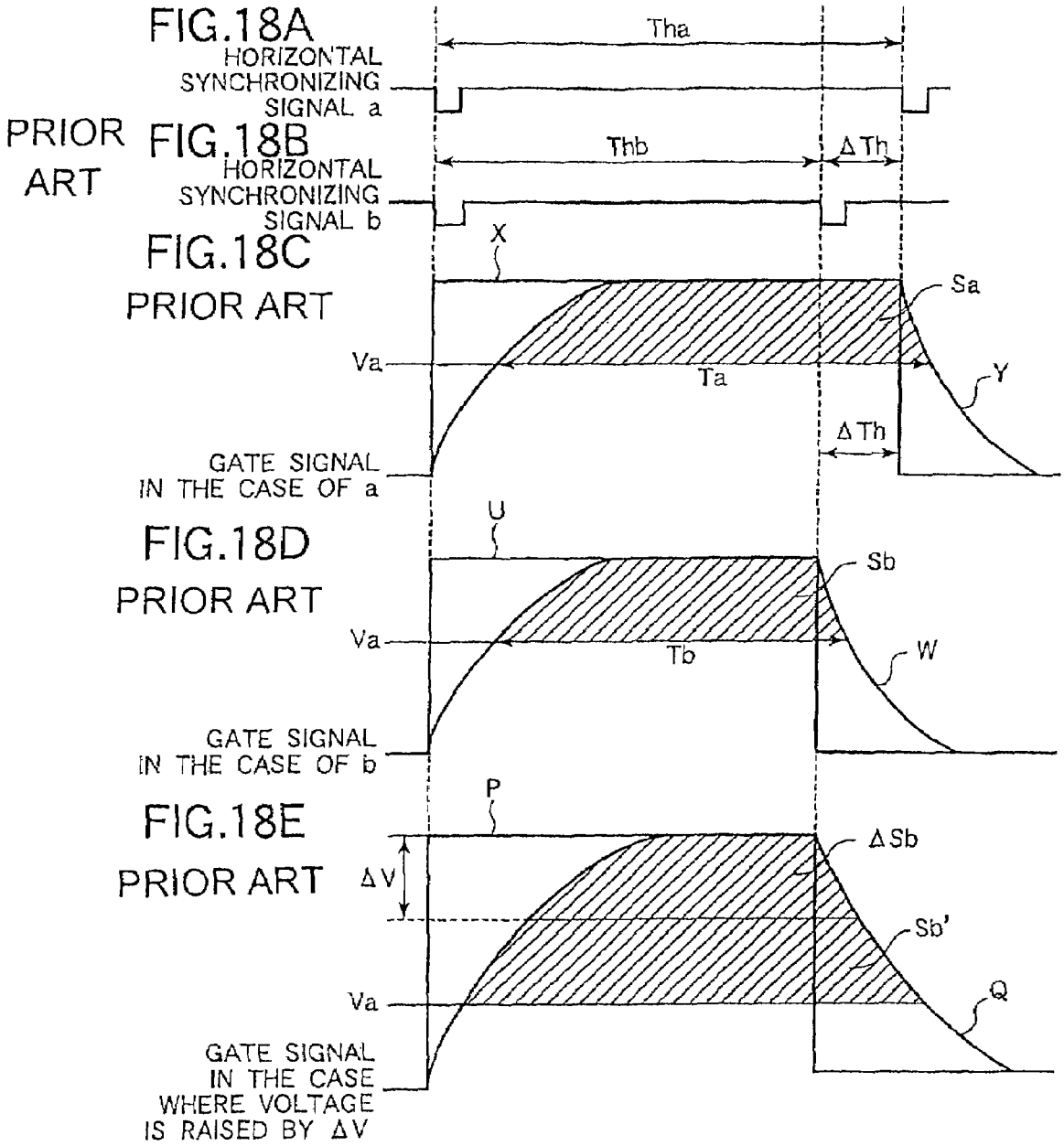
FIG. 18A is a waveform diagram of a horizontal synchronizing signal a with a horizontal scanning frequency of "A" kHz.
FIG. 18B is a waveform diagram of a horizontal synchronizing signal b with a horizontal scanning frequency of "B" kHz.
FIG. 18C is a waveform diagram of a gate signal in the case of FIG. 18A.
FIG. 18D is a waveform diagram of a gate signal in the case of FIG. 18B.
FIG. 18E is a waveform diagram of a gate signal in the case where a gate-on voltage is raised by ΔV.
Figure 19:
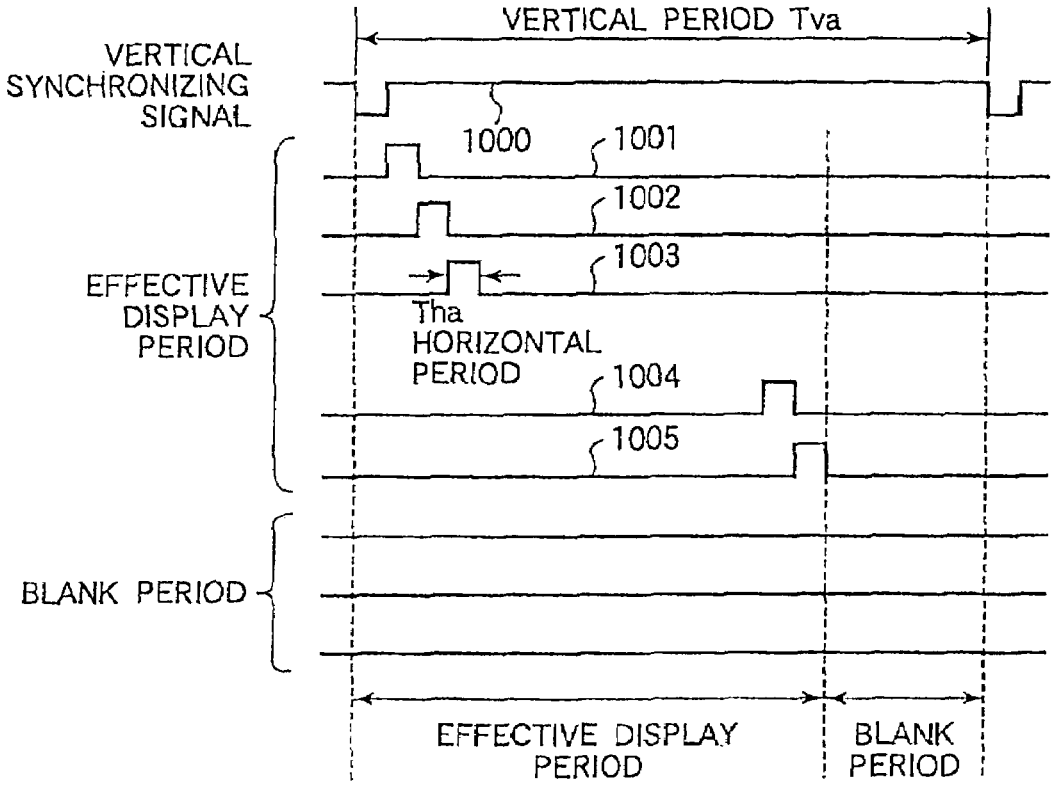
PRIOR ART FIG.19

FIG. 15 shows connection relation between the reference voltage generating circuit 400 and the source driver ICs 500 and 501. For example, eight not-shown source driver ICs, together with the source driver ICs 500 and 501, are connected in parallel to the output terminals of the reference voltage generating circuit 400. The source driver ICs 500 and 501 include the internal resistances 502, 503, 504 and 505 for generating gradation voltages on the basis of the reference voltage. The internal resistances 502 and 504 generate H side gradation voltages, and the internal resistances 503 and 505 generate L side gradation voltages. Voltages of the H side white voltage VW(H) and the H side black voltage VB(H) are applied to both terminals of the internal resistances 502 and 504. Accordingly, a potential difference between the H side white voltage VW(H) and the H side black voltage VB(H) is divided into 255 voltages which become the H side gradation voltages. Besides, the L side white voltage VW(L) and the L side black voltage VB(L) are applied to both terminals of the internal resistances 503 and 505. Accordingly, a potential difference between the L side white voltage VW(L) and the L side black voltage VB(L) is divided into 255 voltages which become the L side gradation voltages. The source driver IC 500 includes the internal resistances 502 and 503, and the source driver IC 501 includes the internal resistances 504 and 505, and therefore, the source driver ICs 500 and 501 can output the H side gradation voltages and the L side gradation voltages.

Next, the output voltage accuracy of the gradation voltage generated by the reference voltage generating circuit 400 and the source driver ICs 500 and 501 will be described. It is assumed that among circuit components constituting the power supply circuit 401, an output voltage of a regulator (not shown) for generating the output voltage and the accuracy of the output voltage are made 12 V±0.5%. A difference between the maximum value and the minimum value of the output voltage becomes 12 V×1%=120 mV. Since the gradation voltage includes the H side and the L side, a difference between the maximum value and the minimum value of the output voltage at one side becomes 60 mV. Besides, it is assumed that the tolerance of the resistors 402, 403, 404, 411, 412 and 413 is 0.1%, and resistance values and accuracy of the internal resistances 502, 503, 504 and 505 are made 10 kΩ±30%. Here, errors of the resistors 402, 403, 404, 411, 412 and 413 are neglected, and the output voltage accuracy of the gradation voltage is calculated. In the following description, although the gradation voltage of the H side will be described, the L side gradation voltage can also be considered in the same way.

The voltages outputted from the amplifiers 405 and 414 are applied to both the terminals of the internal resistances 502 and 504 of the source driver ICs 500 and 501 through the phase compensation resistors 407 and 416. Since the ten source driver ICs are connected in parallel with the other terminals of the resistors 407 and 416, it is possible to regard a combined resistance of 10 kΩ/10=1 kΩ as being connected between the terminals. An output voltage difference of the amplifiers 405 and 414 is made 5 V, the resistance values of the resistors 407 and 416 are respectively made 50Ω, and voltages applied to both ends of the internal resistances of the ten source driver ICs are considered. It can be said that the resistors 407 and 416 and the combined resistance of the internal resistances are connected in series between the terminals of the amplifiers 405 and 414. In the case where the resistors 407 and 416 are made constant, and the internal resistance fluctuates in the range of ±30%, a potential change of a potential V1 at a connection terminal between the resistor 407 and the internal resistance and a potential V2 at a connection terminal between the resistor 416 and the internal resistance can be obtained in the manner described below. A difference ΔV1 between the maximum value and the minimum value of V1 is 5 V×(50Ω+1 kΩ×130%)/(50Ω+1 kΩ×130%+50Ω)−5 V×(50Ω+1 kΩ×70%)/(50Ω+1 kΩ×70%+50Ω)=134 mV. On the other hand, a difference ΔV2 between the maximum value and the minimum value of V2 is 5 V×50Ω/(50Ω+1 kΩ×70%+50Ω)−5 V×50Ω/(50Ω+1 kΩ×130%+50Ω)=134 mV. Incidentally, the L side voltage can also be considered in the same way. In the case of a 256-gradation display, since an output voltage difference of one gradation of a voltage applied to the liquid crystal is 5 V/255=19.6 mV, an error of about seven gradations occurs due to the variation in the internal resistance of the source driver IC. Besides, since the output voltage of the regulating circuit fluctuates by 60 mV, an error of about three gradations occurs. Further, since the variations in the resistors 402, 403, 404, 411, 412 and 413, which were neglected in the above calculation, are also superimposed, the gradation characteristic is changed by manufacture variations in driving circuit components, and variation in picture quality occurs for every liquid crystal display device. In order to uniform the display quality of the liquid crystal display device, it becomes necessary to correct the H side and the L side reference voltages.

An object of the invention is to provide a driving circuit and a driving method of a liquid crystal display device in which the contrast can be changed without decreasing the number of colors of a display screen, and the change of a gradation characteristic caused by characteristic variations in the components used for the driving circuit and in the liquid crystal can be easily corrected.

The driving circuit and the driving method of the liquid crystal display device according to this embodiment will be described with reference to FIGS. 10 to 12. Incidentally, in the following description, an example of a normally black liquid crystal display device which performs a black display when voltage is not applied to a liquid crystal, will be described. First, a circuit structure of a reference voltage generating circuit 200 as one of components constituting the driving circuit of the liquid crystal display device according to this embodiment will be described with reference to FIG. 10. The reference voltage generating circuit 200 generates an applied voltage (black voltage) VB for black display on the liquid crystal display device. A drive voltage of the reference voltage generating circuit 200 is generated by a power supply circuit 217. An output end of the power supply circuit 217 is connected to one terminal of a resistor 203. One terminals of resistors 201 and 204 and one electrode of a capacitor 209 are connected to the other terminal of the resistor 203. The other terminal of a resistor 202, one terminal of a resistor 205, and one electrode of a capacitor 210 are connected to the other terminal of the resistor 204. The other terminal of the resistor 205 is grounded. A transistor 213 is connected between the other terminal of the resistor 201 and one terminal of the resistor 202. A drain electrode of the transistor 213 is connected to the other terminal of the resistor 201, and a source electrode is connected to one terminal of the resistor 202. One electrode of a capacitor 208 is connected to a gate electrode of the transistor 213. Further, a diode 214 is connected between the gate electrode of the transistor 213 and the one electrode of the capacitor 210. Incidentally, the diode 214 is connected such that a direction from the one electrode of the capacitor 210 to the gate electrode of the transistor 213 is a forward direction. A pulse width modulation (PWM) circuit 218 is connected to the other electrode of the capacitor 208. Incidentally, the other electrodes of the capacitors 209 and 210 are grounded.

One input terminal of an amplifier 215 is connected to a connection terminal between the resistor 203 and the resistor 204. An output terminal of the amplifier 215 is connected to one terminal of a phase compensation resistor 206 and is connected to the other input terminal of the amplifier 215. The other terminal of the resistor 206 is connected to one electrode of a capacitor 211 and one terminal of an H side gradation voltage generation internal resistance integrated in a source driver IC (both are not shown). Besides, one input terminal of an amplifier 216 is connected to a connection terminal between the resistor 204 and the resistor 205. An output terminal of the amplifier 216 is connected to one terminal of a phase compensation resistor 207 and is connected to the other input terminal of the amplifier 216. The other terminal of the resistor 207 is connected to one electrode of a capacitor 212 and one terminal of a not-shown L side gradation voltage generation internal resistance integrated in the source driver IC. The other electrodes of the capacitors 211 and 212 are grounded.

Incidentally, the liquid crystal display device is required to perform alternating-current driving to a common voltage Vcom. A voltage outputted to the other terminal of the resistor 206 of the reference voltage generating circuit 200 is an H side black voltage VB(H), and a voltage outputted to the other terminal of the resistor 207 is an L side black voltage VB(L). Besides, a reference voltage generating circuit for generating an H side white voltage VW(H) for white display on the liquid crystal display device and an L side white voltage VW(L) is similar to a conventional reference voltage generating circuit (not shown). Incidentally, as a power supply of the reference voltage generating circuit, the power supply circuit 217 is used.

Next, the operation of the reference voltage generating circuit 200 according to this embodiment will be described. It is assumed that when power is turned on to the reference voltage generating circuit 200, the control signal outputted from the PWM circuit 218 is a low voltage level (for example, 0 V) constant voltage. Since the gate electrode of the transistor 213 is connected to the other terminal of the resistor 204 through the diode 214, the voltage of the gate electrode becomes substantially the same potential as the other terminal of the resistor 204. Besides, since the source electrode of the transistor 213 is connected to the other terminal of the resistor 204 through the resistor 202, it becomes substantially the same potential as the other terminal of the resistor 204. Accordingly, the gate and source voltages of the transistor 213 become substantially the same, and the transistor 213 comes to have an OFF state. At this time, both ends of the resistor 204 have potentials obtained by dividing the voltage between the output voltage of the power supply circuit 217 and the ground in proportion to the resistance values of the resistors 203, 204 and 205. Incidentally, the one electrode of the capacitor 208 comes to have the same potential as the gate electrode of the transistor 213.

Here, it is assumed that the control signal outputted from the PWM circuit 218 is changed to a high voltage level (for example, 3 V) constant voltage. The potential of the other electrode of the capacitor 208 is changed from 0 V to 3 V. Since the one electrode of the capacitor 208 is in the floating state, the potential of the one electrode of the capacitor 208 and the gate electrode of the transistor 213 is raised by 3 V. By this, the voltage between the gate and the source of the transistor 213 becomes 3 V, and the transistor 213 comes to have the ON state. When the transistor 213 is turned ON, the resistor 201, the resistor 202 and the transistor 213 form series connection. A combined resistance generated by the series connection is connected in parallel to the resistor 204. Since a resistance connected between the resistor 203 and the resistor 205 becomes the combined resistance of the resistors 201, 202 and 204 and the ON resistance of the transistor 213, a resistance ratio between the output terminal of the power supply circuit 217 and the ground is changed, and a voltage between both the terminals of the resistor 204 is changed. Incidentally, in the case where the value of the combined resistance becomes larger than the value of the resistor 204 by turning ON the transistor 213, the input voltage of the amplifier 215 is raised, and the input voltage of the amplifier 216 is dropped. On the other hand, in the case where the value of the combined resistance becomes smaller than the value of the resistor 204, the input voltage of the amplifier 215 is dropped, and the input voltage of the amplifier 216 is raised. Further, when the period of repetition of 0 V and 3 V of the control signal outputted from the PWM circuit 218 and the pulse width are changed, the voltage levels of both the terminals of the resistor 204 are changed, and the input voltage levels of the amplifiers 215 and 216 can be changed. Accordingly, the output voltage level of the reference voltage generating circuit 200 can also be changed.

Hereinafter, a specific description will be given by use of examples in which the reference voltage generating circuit 200 of this embodiment is applied to the liquid crystal display device.

Example 2-1

The values of the resistors 201, 202, 203, 204 and 205 are set so that the output voltages of the reference voltage generating circuit 200 become the H side black voltage VB(H) and the L side black voltage VB(L). The output terminals are connected to the other terminals of the H side internal resistance and the L side internal resistance in the not-shown source driver IC. Besides, terminals (not shown) to which the H side white voltage VW(H) and the L side white voltage VW(L) generated by the reference voltage generating circuit 200 are outputted are connected to the one terminals of the H side internal resistance and the L side internal resistance. FIG. 11 shows a characteristic (T-V characteristic) of applied voltage to a liquid crystal and transmissivity. The horizontal axis indicates a difference (applied voltage) between the common voltage Vcom and the gradation voltage as the output voltage of the source driver IC, and the vertical axis indicates the transmissivity. When an applied voltage VB is applied to the liquid crystal, the transmissivity becomes TB. When the applied voltage VB is raised by Δa, the transmissivity TB is raised by ΔA, and therefore, the contrast is lowered. On the contrary, when the black voltage VB is lowered by Δb, the transmissivity TB is lowered by ΔB, and the contrast is raised.

In general, the T-V characteristic of the liquid crystal is not linearly changed, and further varies for every liquid crystal display device. Incidentally, when the pulse width or the like of the PWM circuit 218 is changed, the H side black voltage VB(H) and the L side black voltage VB(L) are changed. Since the output voltages of the reference voltage generating circuit 200 are applied to both the terminals of the internal resistance of the source driver IC, if the pulse width or the like of the PWM circuit 218 is controlled, the black voltage VB can be arbitrarily changed, and the contrast of the liquid crystal display device can be adjusted. However, when the change rate of the pulse width is set to be the same for all liquid crystal display devices, it is conceivable that the change of the contrast does not become constant due to a difference in the T-V characteristic. Then, if the change rate of the pulse width is changed in accordance with the T-V characteristic of the respective liquid crystal display devices, a variable amount of the black voltage VB varies for every liquid crystal display device, and the contrast among the devices can be made the same. Further, although there is a possibility that the reference voltage is different from a designed value due to the variations in the components used for the driving circuit of the liquid crystal display device, since the reference voltage can be regulated, it becomes possible to correct the gradation characteristic for every liquid crystal display device, and the difference in picture quality among the devices can be reduced.

According to the driving circuit and the driving method of the liquid crystal display device of this embodiment, even if an analog input signal of a picture signal transmitted from a system apparatus such as a personal computer is not adjusted, the contrast can be adjusted, and therefore, there does not occur a decrease in the number of display colors due to the contrast adjustment of the liquid crystal display device. Besides, the difference in picture quality among devices due to variations in the components of the driving circuit and variations in the characteristics of the liquid crystal can be sufficiently decreased by changing the reference voltage and correcting the gradation characteristic.

Figure 10:
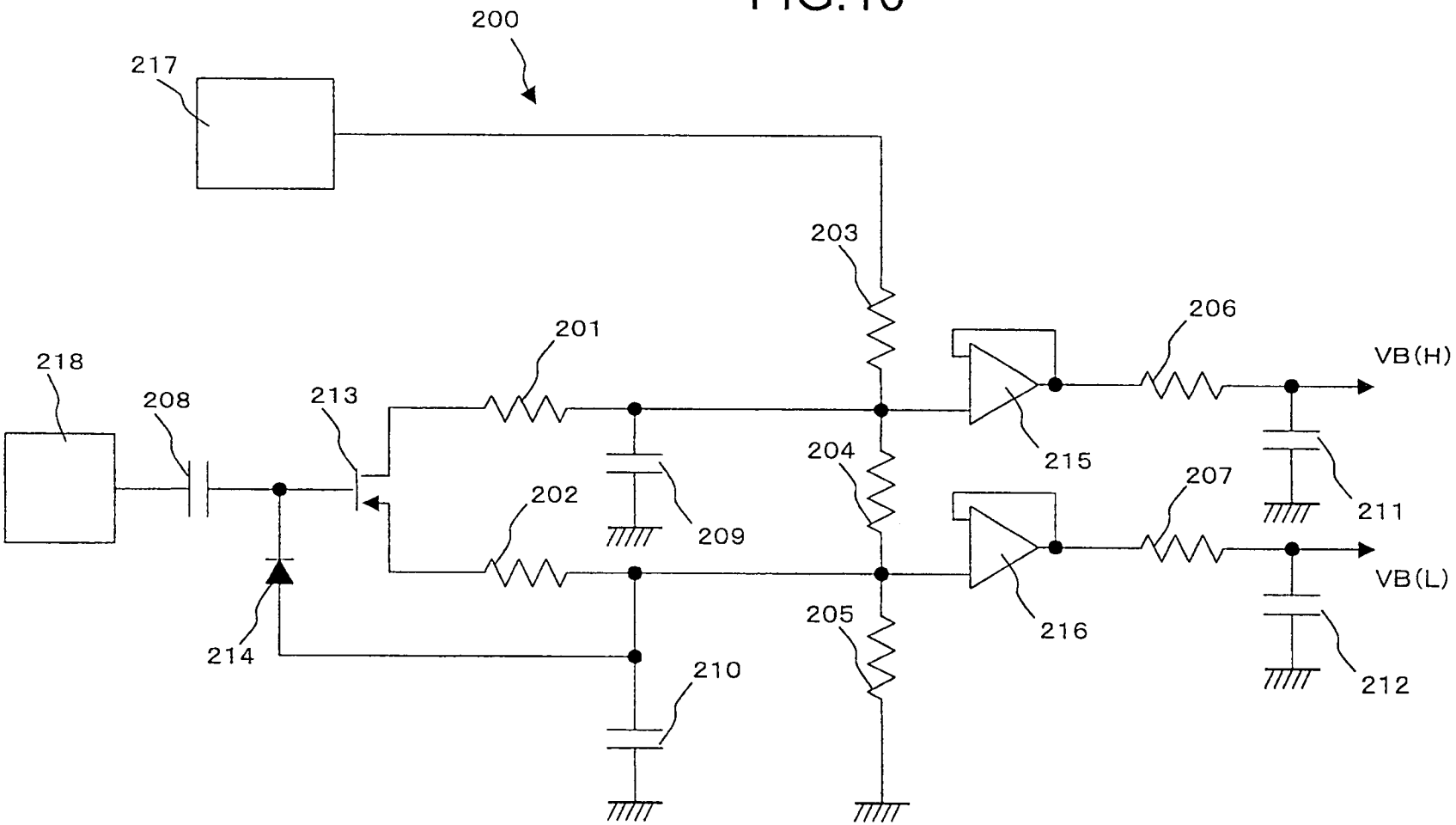
FIG. 10 is a view showing a circuit structure of a reference voltage generating circuit 200 according to a second embodiment of the invention.
Figure 11:
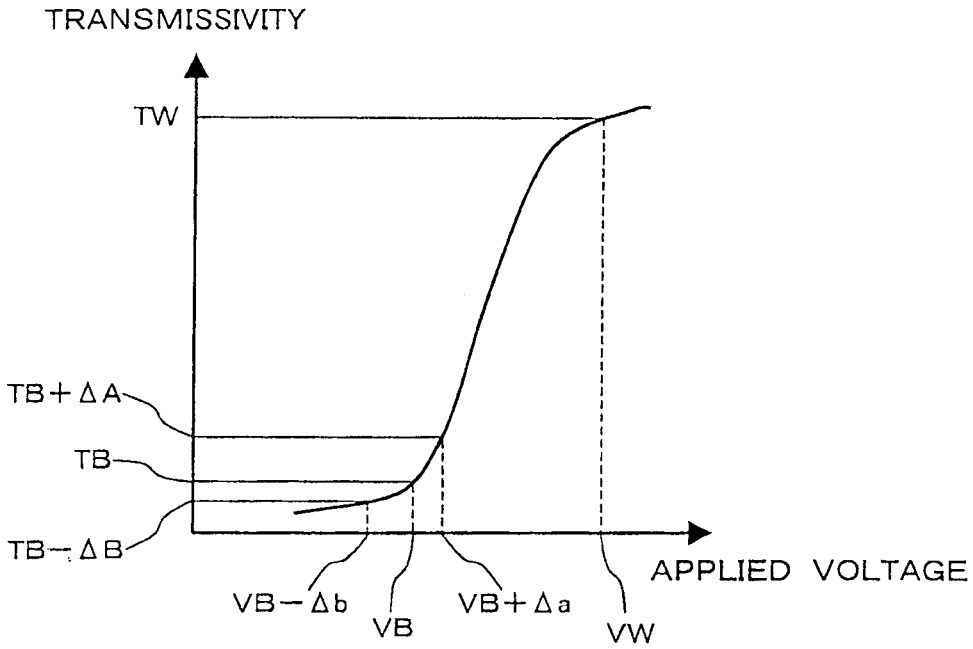
FIG. 11 is a view showing a characteristic (T-V characteristic) of voltage applied to liquid crystal and transmissivity.

Although the reference voltage generating circuit 200 shown in FIG. 10 has the structure capable of changing the H side black voltage VB(H) and the L side black voltage VB(L), the same effect can be obtained even if it has such a structure that the H side white voltage VW (H) and the L side white voltage VW(L) can be changed, or all of the H side black voltage VB (H), the L side black voltage VB(L), the H side white voltage VW(H) and the L side white voltage VW(L) can be changed.

Example 2-2

Figure 12A:
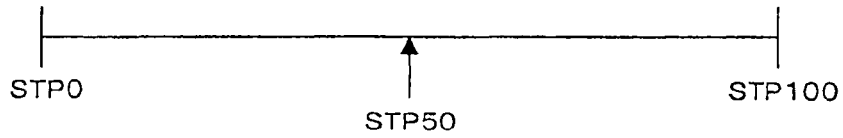
FIGS. 12A to 12E are views for explaining an adjustment range of the contrast and a setting state of the contrast of a liquid crystal display device at the time of shipment.
Figure 12B:
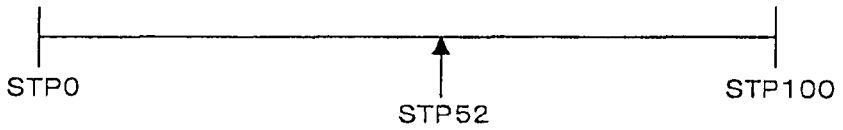

An example 2-2 of this embodiment will be described with reference to FIGS. 12A to 12E. In this example, a range of contrast adjustment performed by a user of the liquid crystal display device will be described. FIGS. 12A to 12E are views for explaining the adjustment range of the contrast and the setting state of the contrast of the liquid crystal display device at the time of shipment. In the description of this example, it is assumed that the user can perform the adjustment of 100 steps. FIG. 12A shows the contrast adjustment range and the design specification of the setting state at the time of shipment. It is assumed that the designed contrast is obtained when the setting of the adjustment step is made STP50. Accordingly, the optimum setting (=initial value) of the contrast at the time of shipment is STP50. FIG. 12B shows a state in which the setting of the adjustment step at the time of shipment is shifted by variations in the components of the driving circuit and in the T-V characteristic of the liquid crystal. It is assumed that unless a setting is made to STP52, the contrast as designed can not be obtained. It is conceivable that the setting of the liquid crystal display device at the time of shipment is made to STP50 or STP52. When it is shipped at the setting of STP50, the contrast varies for every liquid crystal display device, so that a difference occurs in picture quality among the devices. On the other hand, when it is shipped at the setting of STP52, since the contrast at the time of shipment becomes the same, the picture quality is uniformed among the devices. However, there occurs a disadvantage that even if STP100 is set in order to raise the contrast, only the contrast corresponding to designed STP98 can be obtained.

Figure 12C:
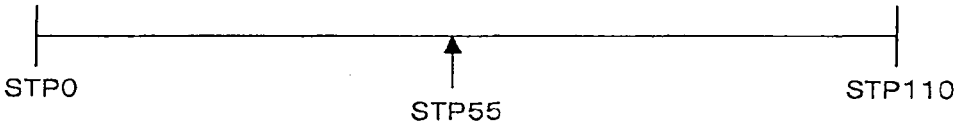
Figure 12D:
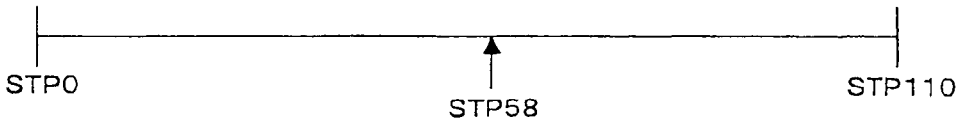
Figure 12E:
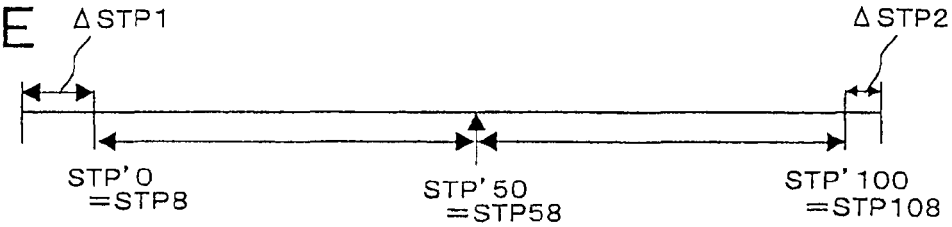

Then, as shown in FIG. 12C, a margin is set in the adjustment step of the contrast, and it is designed such that for example, 110 steps can be performed. In this case, the optimum setting (=initial value) of the contrast at the time of shipment becomes STP55. FIG. 12D shows a state in which the setting of the adjustment step at the time of shipment is shifted by the variations in the components of the driving circuit and in the T-V characteristic of the liquid crystal. It is assumed that the contrast as designed is obtained at the setting of STP58. When shipment is performed at the setting, the contrast as designed is obtained, so that a difference in picture quality for every liquid crystal display device does not occur. As shown in FIG. 12E, the setting of STP58 is set to STP'50. In order to raise the contrast, STP'50 is increased by 50 steps and is made STP'100. At this time, although an actual step becomes STP108, since the adjustment step can be changed up to STP110, the maximum contrast of the designed specification can be obtained. If the pulse width of the control signal outputted from the PWM circuit 218 is changed in 110 ways, 110 reference voltages can be obtained. Accordingly, the contrast between the minimum contrast and the maximum contrast can be divided in 110 ways.

Example 2-3

In an example 2-3 of this embodiment, a method of raising or lowering the contrast of a part of a display screen by using the reference voltage generating circuit 200 of this embodiment will be described. For example, as in a movie, even in the case where a black screen is displayed at parts above and below a picture portion, there can occur a case where the picture portion is overall dark and becomes a blackened display, and the details are hard to see. In order to make the details visible, a black voltage is raised, so that the screen becomes bright and the details can be seen. However, since the upper and lower black parts of the screen also become bright, the black parts become noticeable. Then, when the driving is made such that the H side black voltage VB(H) is raised only when the gradation voltage is applied to the pixels displaying the picture portion, and the L side black voltage VB (L) is lowered, the black in the picture portion becomes brighter than the black of the upper and lower black display of the screen, so that the picture portion can be made noticeable. In order to obtain a similar effect, when the driving is made such that the H side black voltage VB(H) is lowered only when the gradation voltage is applied to the pixels displaying the upper and lower black parts of the screen, and the L side black voltage VB(L) is raised, the black of the upper and lower black display of the screen becomes darker, so that the picture portion becomes noticeable. Besides, with respect to the reference voltage regulation, the same effect can be obtained even if only the H side white voltage VW(H) and the L side white voltage VW(L) are regulated, or all of the H side black voltage VB(H), the L side black voltage VB(L), the H side white voltage VW(H) and the L side white voltage VW(L) are regulated. Incidentally, the timing when the reference voltage such as the H side black voltage VB(H) can be changed is set in a part of one display frame and between the timing when the gate voltage VG of the liquid crystal driving TFT becomes ON and the timing when the gradation voltage is outputted from the source driver IC.

As described above, according to this embodiment, it is possible to achieve the driving circuit and the driving method of the liquid crystal display device in which the contrast can be changed without decreasing the number of colors of the display screen, and the change in the gradation characteristic caused by the variations in the components used for the driving circuit and in the characteristics of the liquid crystal can be easily corrected.

Although the embodiment of the invention has been described, the invention is not limited to this. For example, although the example has been described in which the common voltage regulating circuit 31 and the gate voltage regulating circuit 32 are provided in the drive control circuit 30 of the liquid crystal display device 100, it is not necessary to always provide them in the liquid crystal display device 100, and the gate voltage regulating circuit 32 and the common electrode regulating circuit 31 may be provided in a system side such as a computer. Besides, the drive control circuit 30, the data driver 10 and the gate driver 20 may be formed on one substrate of the LCD panel 40 by using polycrystalline silicon or the like. Further, the foregoing circuit is an example, and a circuit having another circuit structure and the same function may be naturally used.

As described above, according to the invention, the gate-on voltage can be supplied such that even in the case where the vertical scanning frequency or the horizontal scanning frequency is changed, the display quality is not degraded.

What is claimed is:

1. A method for correcting gradation voltage characteristics of a liquid crystal display device having a reference voltage generating circuit which includes a fixed voltage divider circuit for outputting a predetermined drive voltage from an input power supply for generating a reference voltage, and a gradation voltage generating circuit for generating gradation voltages based on the reference voltage output by the reference voltage generating circuit, said method comprising the step of:

maintaining a substantially constant input power supply to the reference voltage generating circuit;

correcting the predetermined drive voltage output from the fixed voltage divider circuit with a control circuit which varies the resistance in the fixed voltage divider circuit, the control circuit including a pulse width modulation circuit for generating signals with different pulse widths under a predetermined condition, a transistor controlled by the pulse width modulation circuit, and at least a pair of resistors connected in series with the transistor and in parallel with at least one resistor in the fixed voltage divider circuit; and applying the changed predetermined drive voltage to the gradation voltage generating circuit;

wherein the reference voltage is an applied voltage for black display and/or white display.

2. A method for correcting gradation voltage characteristics of a liquid crystal display device according to claim 1, wherein the level of the reference voltage is changed by pulse width modulation control.

3. A method for correcting gradation voltage characteristics of a liquid crystal display device according to claim 2, wherein the pulse width modulation is performed on the basis of the applied voltage to the liquid crystal and a characteristic of transmissivity.

4. A method for correcting gradation voltage characteristics of a liquid crystal display device according to claim 2, wherein the pulse width modulation is performed on the basis of variations in liquid crystal material and in liquid crystal driving electric components.

5. A method for correcting gradation voltage characteristics of a liquid crystal display device according to claim 1, wherein a variable amount of the level of the reference voltage includes a variation range of contrast.

6. A method for correcting gradation voltage characteristics of a liquid crystal display device according to claim 1, wherein the level of the reference voltage is changed in a part of one display frame.

7. A method for correcting gradation voltage characteristics of a liquid crystal display device according to claim 6, wherein a timing of changing the level of the reference voltage is between turning-ON of a gate electrode of a pixel transistor and application of a gradation voltage to a drain electrode of the pixel transistor.

8. A drive control circuit of a liquid crystal display device, comprising:

a reference voltage generating circuit for generating a reference voltage, said reference voltage generating circuit including a fixed voltage divider circuit for outputting a predetermined drive voltage converted by said reference voltage generating circuit for generating the reference voltage;

a control circuit for correcting the predetermine drive voltage output from the fixed voltage divider circuit by varying the resistance in the fixed voltage divider circuit, the control circuit including a pulse width modulation circuit for generating signals with different pulse widths under a predetermined condition, a transistor controlled by the pulse width modulation circuit, and at least a pair of resistors connected in series with the transistor and in parallel with at least one resistor in the fixed voltage divider circuit; and a gradation voltage generating circuit for generating gradation voltages based on the reference voltage output by the reference voltage generating circuit;

wherein the reference voltage is an applied voltage for black display and/or white display.

9. A liquid crystal display device comprising a liquid crystal sealed between substrates disposed to be opposite to each other with a predetermined cell gap, further comprising a drive control circuit for driving the liquid crystal according to claim 8.

* * * * *